US006976696B2

(12) United States Patent
O'Krangley et al.

(10) Patent No.: US 6,976,696 B2
(45) Date of Patent: Dec. 20, 2005

(54) TRANSPORTABLE MEDICAL APPARATUS

(75) Inventors: Jason M. O'Krangley, Caledonia, MI (US); David M. Kruithoff, Grand Rapids, MI (US)

(73) Assignee: NeoMedTek, Caledonia, MI (US)

( * ) Notice: Subject to any disclaimer, the term of this patent is extended or adjusted under 35 U.S.C. 154(b) by 86 days.

(21) Appl. No.: 10/652,671

(22) Filed: Aug. 29, 2003

(65) Prior Publication Data

US 2004/0088792 A1 May 13, 2004

Related U.S. Application Data

(60) Provisional application No. 60/407,348, filed on Aug. 30, 2002.

(51) Int. Cl.[7] ..... A47B 1/00

(52) U.S. Cl. ..... 280/640; 280/638; 5/627; 5/611; 296/20

(58) Field of Search ..... 280/640, 638; 5/627, 86.1, 611; 296/20; 248/188.6

(56) References Cited

U.S. PATENT DOCUMENTS

| | | | | | |
|---|---|---|---|---|---|
| 2,833,587 | A | | 5/1958 | Saunders | 296/20 |
| 2,877,047 | A | | 3/1959 | Weil | 296/20 |
| 3,673,620 | A | | 7/1972 | Saunders | 5/63 |
| 3,820,383 | A | | 6/1974 | Limpach | 296/20 |
| 4,097,941 | A | * | 7/1978 | Merkel | 295/20 |
| 4,192,541 | A | * | 3/1980 | Ferneau | 296/20 |
| 4,405,172 | A | | 9/1983 | Ferneau | 296/20 |
| 4,489,449 | A | | 12/1984 | Failor et al. | 5/86 |
| 4,682,810 | A | * | 7/1987 | Zarka | 296/20 |
| 4,767,148 | A | * | 8/1988 | Ferneau et al. | 296/20 |
| 4,912,787 | A | | 4/1990 | Bradcovich | 5/62 |
| 4,921,295 | A | * | 5/1990 | Stollenwerk | 296/20 |
| 5,015,024 | A | * | 5/1991 | Bloemer | 296/20 |
| 5,022,105 | A | | 6/1991 | Catoe | 5/11 |
| 5,083,625 | A | | 1/1992 | Bleicher | 180/65.1 |
| 5,343,581 | A | | 9/1994 | Bartley et al. | 5/611 |
| 5,365,622 | A | | 11/1994 | Schirmer | 5/611 |
| 5,509,159 | A | * | 4/1996 | Du-Bois | 5/627 |
| 5,537,700 | A | * | 7/1996 | Way et al. | 5/611 |
| 5,701,618 | A | | 12/1997 | Brugger | 5/611 |
| 5,983,425 | A | * | 11/1999 | DiMucci et al. | 5/611 |
| 5,987,673 | A | * | 11/1999 | Smith | 5/627 |
| 6,070,899 | A | * | 6/2000 | Gines | 280/651 |
| 6,389,623 | B1 | * | 5/2002 | Flynn et al. | 5/611 |
| 6,405,393 | B2 | * | 6/2002 | Megown | 5/611 |
| 6,526,611 | B2 | * | 3/2003 | Flynn et al. | 5/611 |
| 6,575,491 | B2 | * | 6/2003 | Miller | 280/638 |
| 6,654,973 | B2 | * | 12/2003 | Van Den Heuvel et al. | 5/611 |
| 6,701,545 | B1 | * | 3/2004 | Ferneau et al. | 5/86.1 |
| 6,735,794 | B1 | * | 5/2004 | Way et al. | 5/86.1 |
| 2003/0172459 | A1 | * | 9/2003 | Roussy | 5/611 |
| 2004/0111798 | A1 | * | 6/2004 | Matunaga et al. | 5/86.1 |

* cited by examiner

*Primary Examiner*—J. Allen Shriver
(74) *Attorney, Agent, or Firm*—Van Dyke, Gardner, Linn & Burkhart, LLP

(57) ABSTRACT

An undercarriage for transporting a stretcher includes a support base, which is adapted for supporting a stretcher, a first pair of legs pivotally mounted to the support base, and a second pair of legs pivotally and slidably mounted to the support base. The first pair of legs is independently pivotal about the support base from the second pair of legs. In addition, a journaled member is provided at the distal ends of each leg. The undercarriage also includes a control system that is adapted to selectively pivot the first pair of legs to a stowed position and to selectively pivot the second pair of legs to a stowed position. The control system is further adapted to selectively lengthen or shorten the legs to adjust the height of the support base.

23 Claims, 20 Drawing Sheets

TRANSPORTABLE MEDICAL APPARATUS

This application claims priority from provisional application entitled TRANSPORTABLE MEDICAL APPARATUS, Ser. No. 60/407,348, filed Aug. 30, 2002, which is incorporated herein by reference in its entirety.

TECHNICAL FIELD AND BACKGROUND OF THE INVENTION

The present invention is generally directed to a transportation device for transporting a person, especially in a medical situation.

Transportation equipment for patients, such as cots or stretchers, which are used to transport a patient in a vehicle, such as an ambulance or aircraft, including a helicopter, are well known. Most equipment of this type include a wheeled undercarriage and a stretcher that is removably mounted to the undercarriage. The equipment, however, is relatively heavy and cumbersome to handle. As a result, the equipment usually requires two or more persons to load the equipment onto the vehicle. Furthermore, the equipment is typically not adjustable and, therefore, cannot readily adapt to the needs of the persons, most often paramedics, who handle the equipment.

Consequently, there is a need for a patient transportation device that can facilitate loading of the device onto a vehicle, including an aircraft, such as a helicopter, and can provide adjustment so that it may be adjusted to the needs of the person handling the device.

SUMMARY OF THE INVENTION

Accordingly, the present invention provides an undercarriage for transporting a stretcher, which includes a support base that is adapted for supporting a stretcher and first and second pairs of legs, which are pivotally mounted to the support base, with each leg including a journaled member to permit the undercarriage to be moved across a support surface, such as the ground, a floor, or the like. The second pair of legs is slidably mounted to the base and is independently pivotal about the support base from the first pair of legs. The undercarriage further includes a control system that is adapted to selectively pivot the legs to stowed positions and, further, adapted to selectively lengthen or shorten the legs to adjust the height of the support base.

In one aspect, the stowed position of the first pair of legs is located between the upper surface and the lower surface of the support base to thereby provide a compact arrangement. In another aspect, the stowed position of the second pair of legs is between the upper and lower surfaces of the support base. For example, the second pair of legs may be at least partially extended into the support base when moved to their stowed position to thereby provide a compact undercarriage.

According to yet another aspect, the support base includes a plurality of journaled members that enable a person to translate the undercarriage across the support surface when the first pair of legs are pivoted to their stowed position and also when the second pair of legs are pivoted to their stowed position. The journaled members preferably include at least one pair of forward journaled members to provide support to the support base when the support base is initially loaded onto the support surface and the forward legs are at least initially pivoted. In addition, another group of the journaled members of the support base are preferably located forward of the rearward legs and rearward of the forward legs to form intermediate journaled members such that the intermediate journaled members provide support for the undercarriage when the forward legs are fully pivoted to their stowed position to thereby ease handling of the undercarriage. For example, the intermediate journaled members may be located at or near the center of gravity of the undercarriage and are optionally located rearward of the center of gravity.

According to other aspects, the control system includes a plurality of cylinders that pivot and adjust the length of the legs. For example, the cylinders may comprise hydraulic cylinders. Furthermore, each of the legs preferably includes a pivot cylinder and a height adjustment cylinder, wherein the pivoting and the height adjusting is independent. In order to maintain the level of the support base, the adjustment cylinders are preferably coupled. In the case where the cylinders comprise hydraulic cylinders, the cylinders may be hydraulically coupled.

Accordingly, the present invention provides an undercarriage for transporting a stretcher, which facilitates loading of the stretcher into a vehicle, including an aircraft, such as a helicopter, and, further, can provide adjustment so that the height of the support base may be adjusted to the needs of the person handling the undercarriage.

These and other objects, advantages, purposes, and features of the invention will become more apparent from the study of the following description taken in conjunction with the drawings.

BRIEF DESCRIPTION OF THE DRAWINGS

FIG. 27A is an enlarged schematic view of a quick disconnect of the control system;

DETAILED DESCRIPTION OF THE PREFERRED EMBODIMENTS

Figure 1:
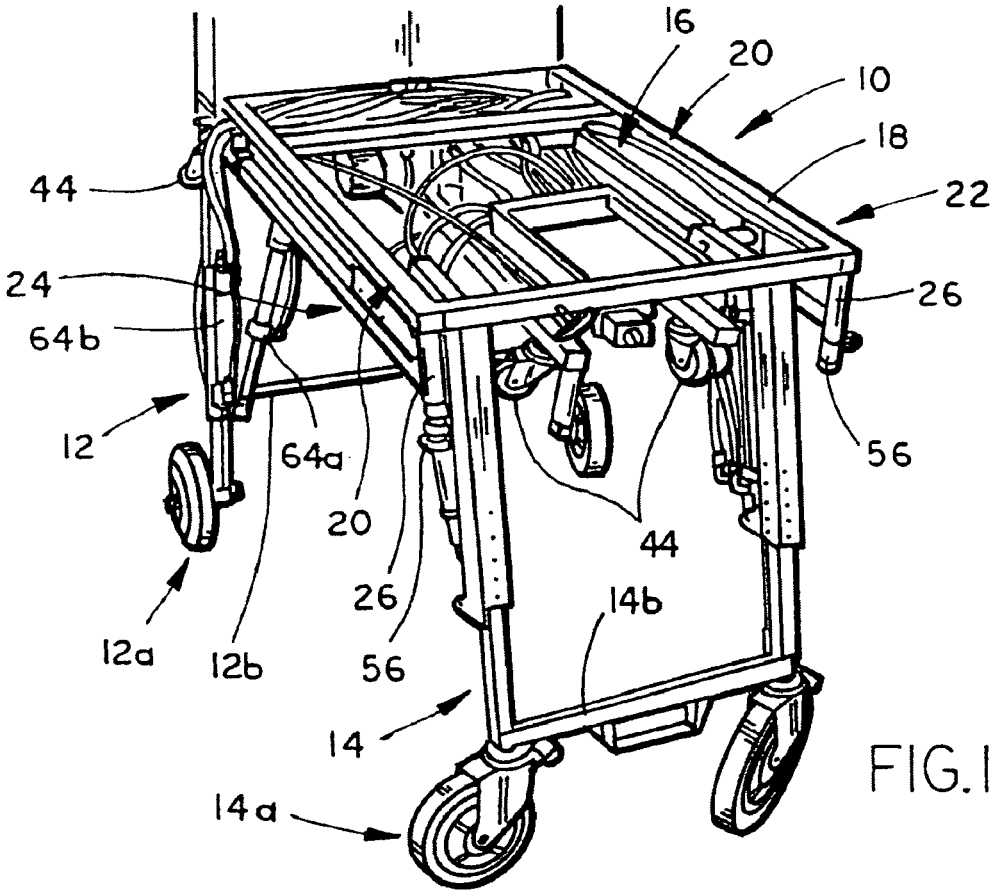
FIG. 1 is a perspective view of an undercarriage of a transportation device of the present invention.
Figure 2:
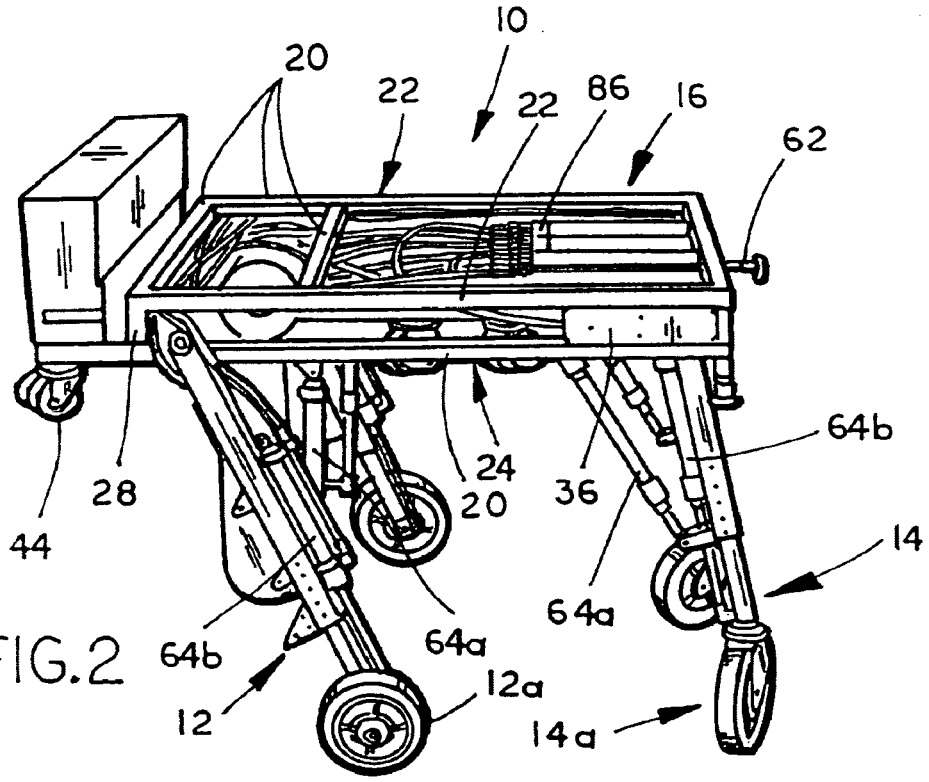
FIG. 2 is a side perspective view of the undercarriage of FIG. 1 illustrating the forward legs of the undercarriage in a partially pivoted position.
Figure 3:
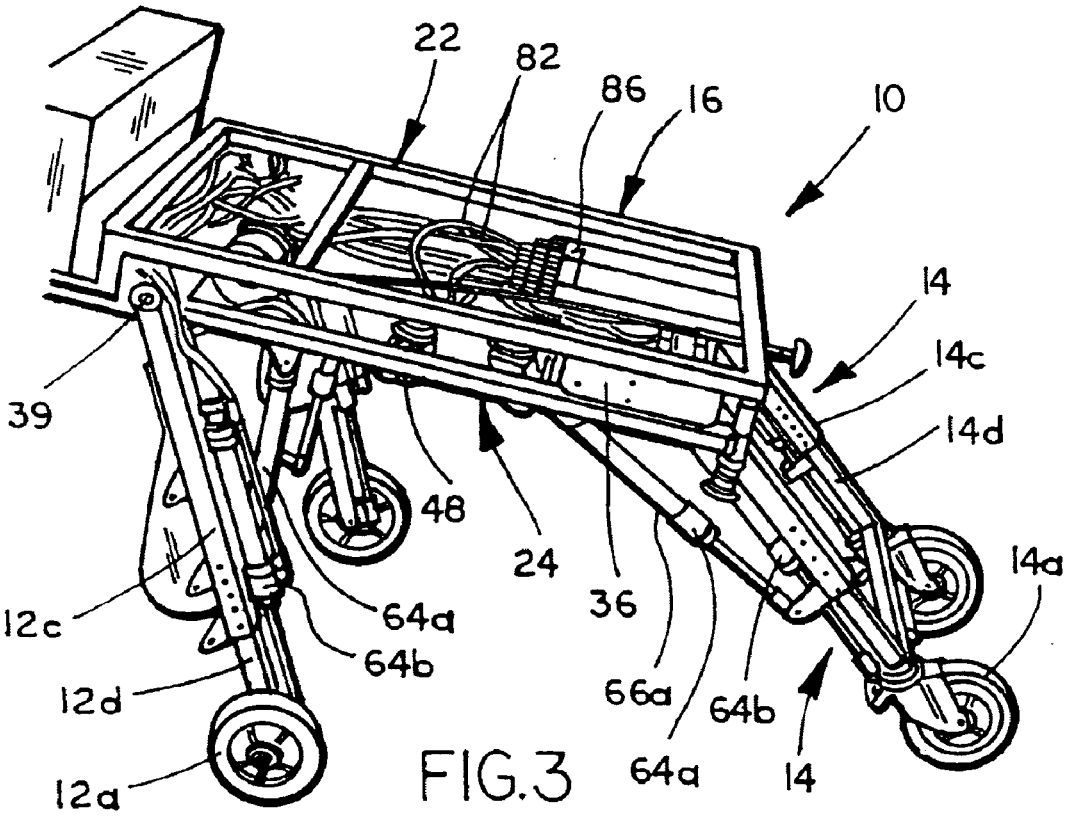
FIG. 3 is a similar view to FIG. 2 with the rearward legs partially pivoted.
Figure 4:
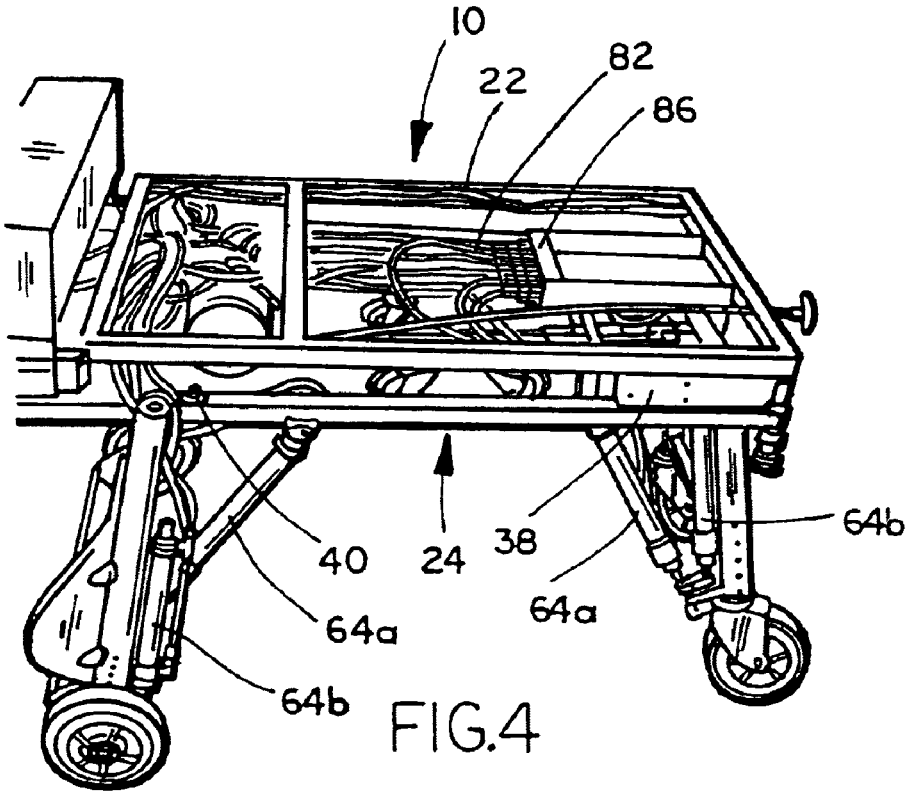
FIG. 4 is a side elevation view of the undercarriage illustrating the legs in a lowered position.

Referring to FIG. 1, the numeral 10 generally designates an undercarriage of the present invention. Undercarriage 10 is particularly suitable for use in transporting a stretcher (not shown) and for loading the stretcher onto a vehicle, including an aircraft, such as a helicopter. As will be more fully described below, undercarriage 10 includes a support base 18, a forward pair of legs 12, and a rearward pair of legs 14, which are pivotally mounted to support base 18 and are selectively pivoted to stowed positions so that undercarriage 10 can be loaded onto the vehicle (not shown). In addition, undercarriage 10 includes a control system 16 that enables the person loading the undercarriage to control the pivoting of the respective legs and, further, to raise and lower the height of the support base 18 to ease handling of undercarriage 10. As will be appreciated from the following description, support base 18 is configured and legs 12 and 14 are pivoted in a manner to permit a single person, such as a paramedic, to load the undercarriage and stretcher onto a vehicle.

Support base 18 is adapted to releasably mount to a stretcher inside the base of the stretcher. Referring to FIGS. 1–4, support base 18 is formed from a plurality of horizontally arranged structural members 20, such as tubular members, that are interconnected, for example by welding, to form an upper frame 22 and a lower frame 24. In the illustrated embodiment members 20 comprise stainless steel tubular members and are interconnected by welding; however, it should be appreciated that other structural members and other methods of connection may be used. Upper frame 22 and lower frame 24 are interconnected by vertical frame members 26 and 28 to form an open frame with a compartment in which at least some of the components of control system 16 may be mounted and, further, into which rear legs 14 may be stowed, as will be more fully described below.

Figure 8:
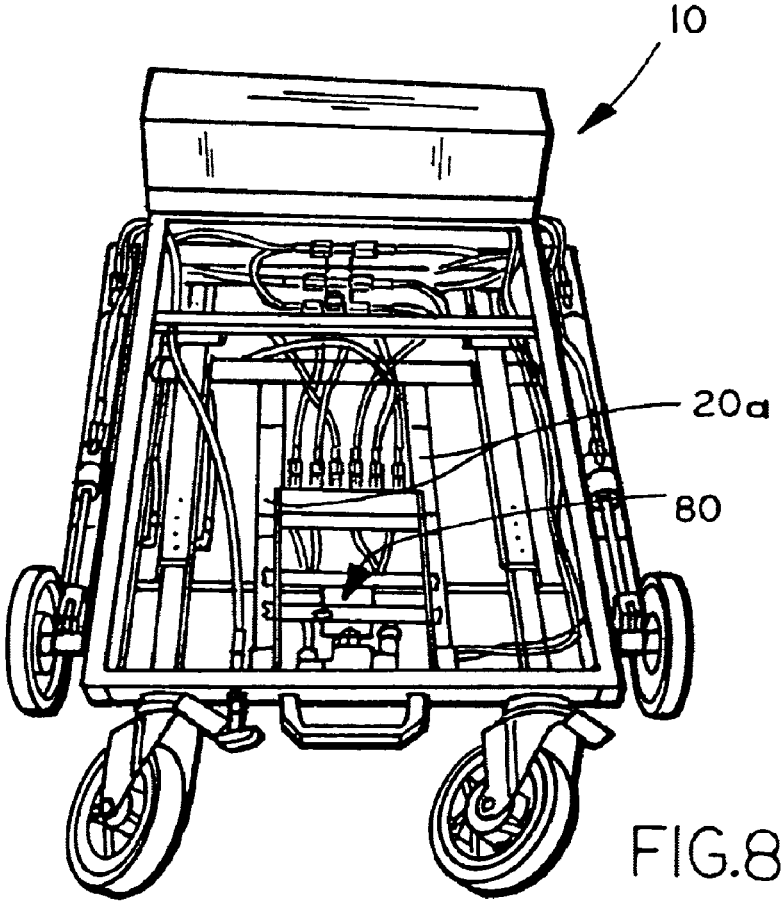
FIG. 8 is a top view of the undercarriage of FIG. 1 in a stowed configuration with the legs in their fully pivoted and stowed positions.
Figure 9:
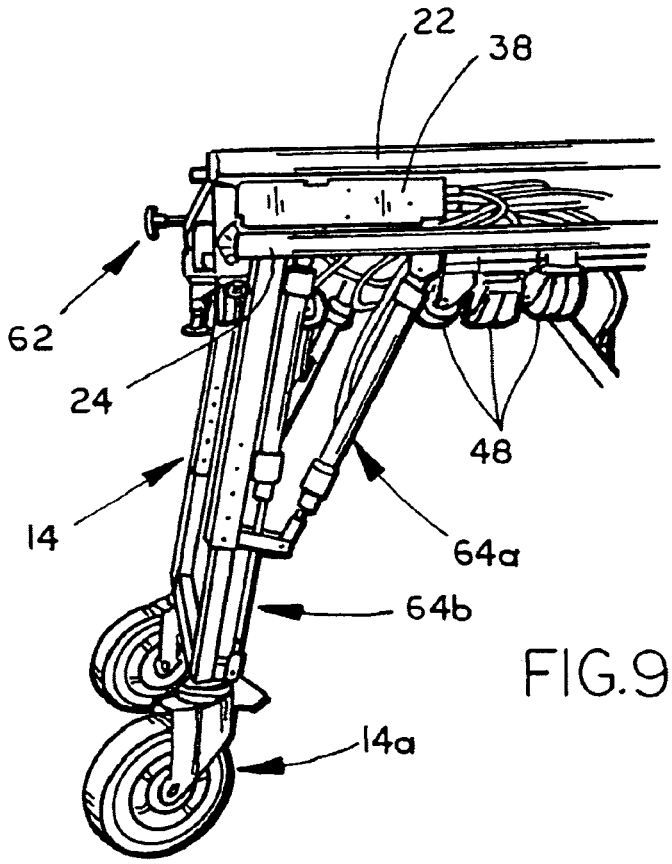
FIG. 9 is a perspective view of the undercarriage illustrating the legs in an extended configuration.
Figure 10:
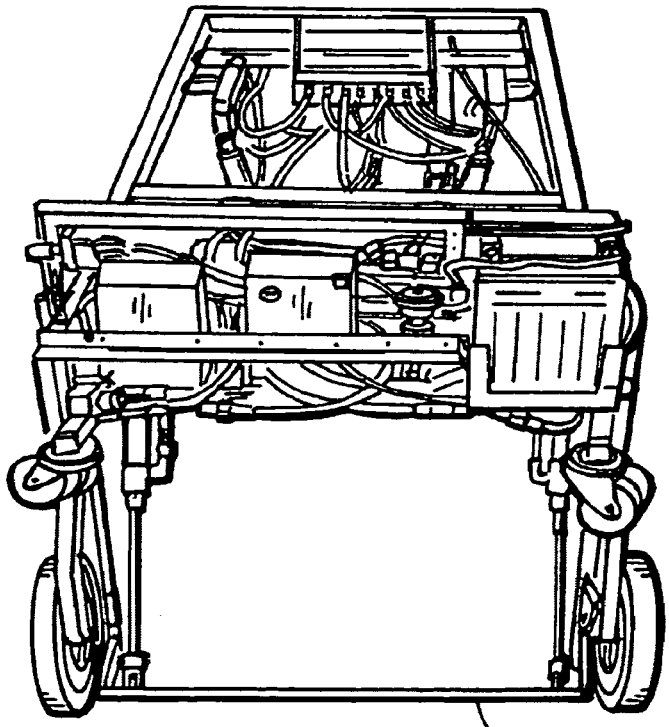
FIG. 10 is a front perspective view of the undercarriage of FIG. 1.
Figure 11:
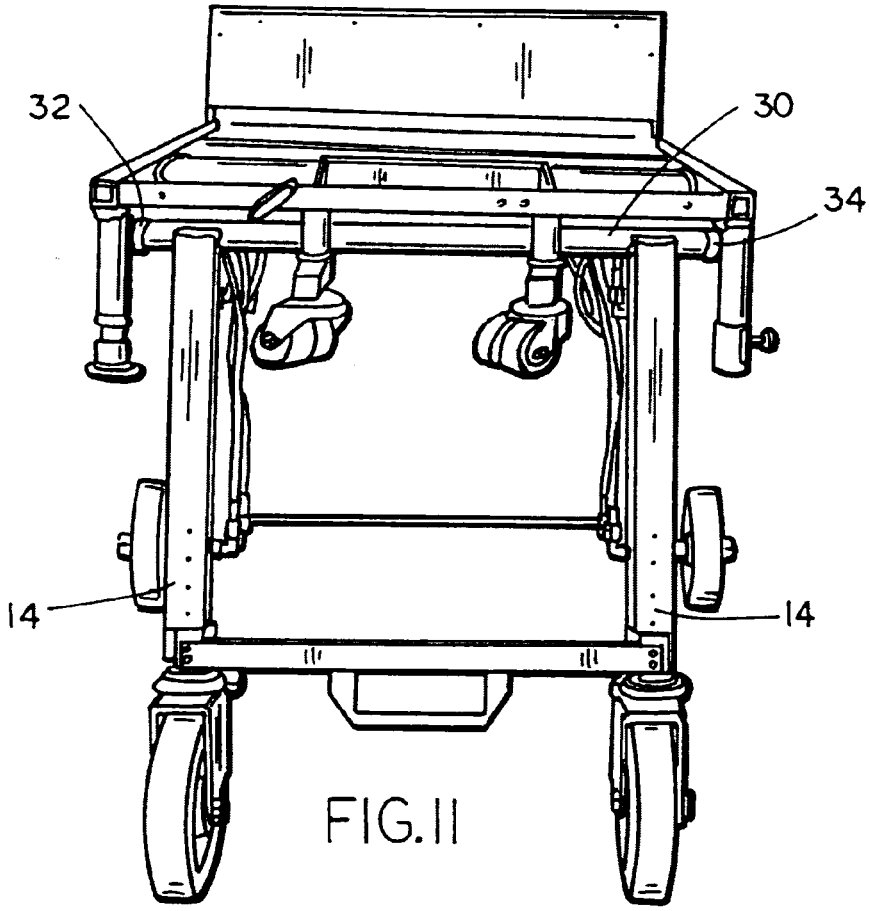
FIG. 11 is a rearward end elevation view of the undercarriage of FIG. 1.
Figure 20:
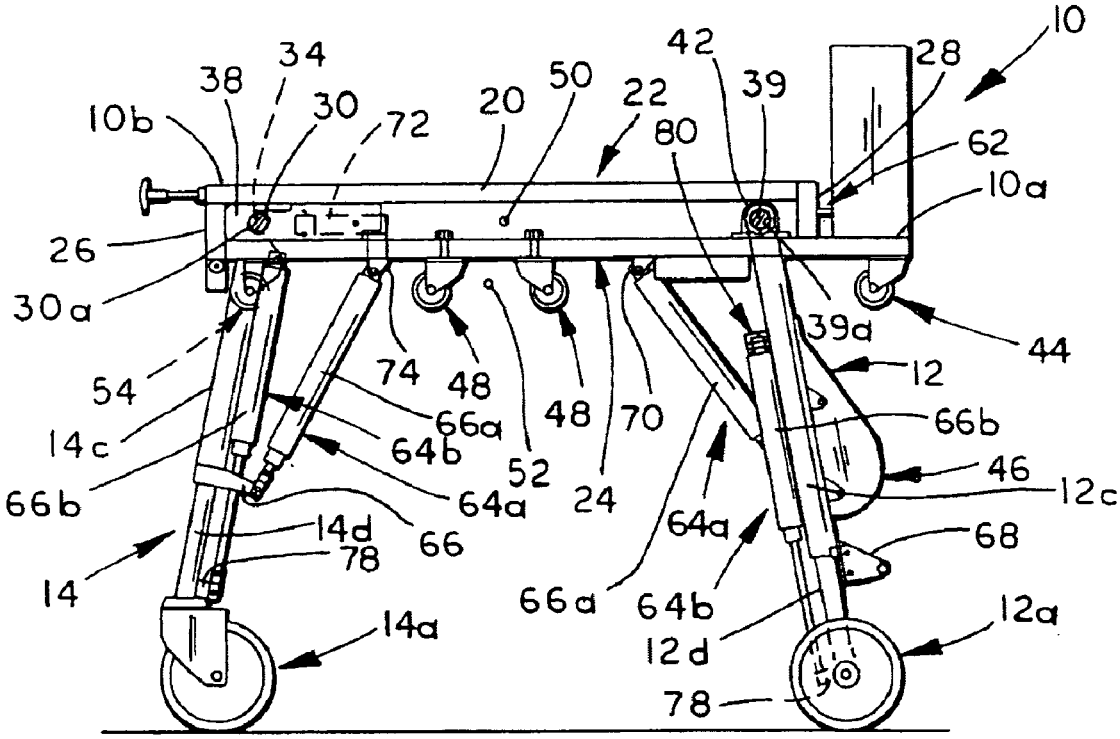
FIG. 20 is a side elevation view of the undercarriage of FIG. 1 with the details of the control system removed for clarity.

In the illustrated embodiment, lower frame 24 provides a mounting surface for forward and rearward pivotal legs 12 and 14. Furthermore, each leg 12, 14 includes a journaled member 12*a*, 14*a*, such as a wheel, roller, caster, or the like, to permit undercarriage 10 to be moved relative to a support surface, such as the ground or floor of a hospital or the like, when the legs are in their operative, lowered positions. As best seen in FIGS. 11 and 20, rearward legs 14 are pivotally mounted to support base 18 by a transverse shaft or axle 30, which is journaled in collars 32 and 34. The distal ends of rearward legs 14 are interconnected by a brace 14*b* (FIG. 1), while the proximal ends of rearward legs 14 are rigidly mounted to shaft 30; therefore, legs 14 rotate in unison along with shaft 30 about pivot axis 30*a*. Collars 32 and 34 are mounted to brackets 36 and 38 (FIGS. 4, 9, and 20), which in turn are mounted between upper frame 22 and lower frame 24. Brackets 36 and 38 comprise plate brackets and are supported for linear movement along support base 18 between upper and lower frames 22 and 24 on linear motion bearing assemblies 25 (FIGS. 9, 20A, and 20B) that are mounted to horizontal members 20 of upper and lower frames 22, 24 so that when rearward legs 14 are fully pivoted, legs 14 can be retracted into support base 18 in to the open compartment defined by upper and lower frames 22 and 24 to provide a compact undercarriage when the undercarriage is loaded onto a support surface (FIG. 8). As will be more fully described below, brackets 36 and 38 also provide a mounting surface for the respective pivot actuators for rearward legs 14.

Figure 20B:
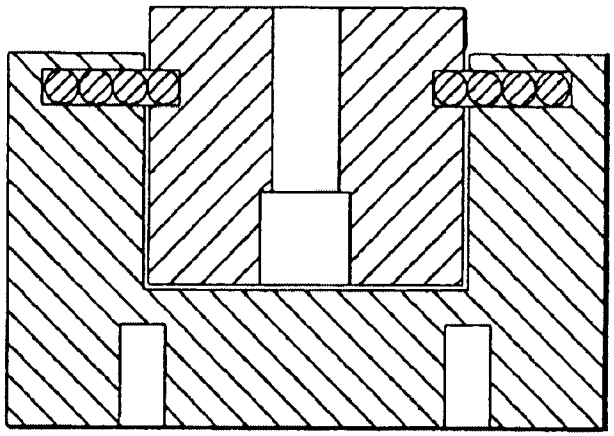
FIG. 20B is a cross-section taken along line XXB—XXB of FIG. 20A.
Figure 20A:
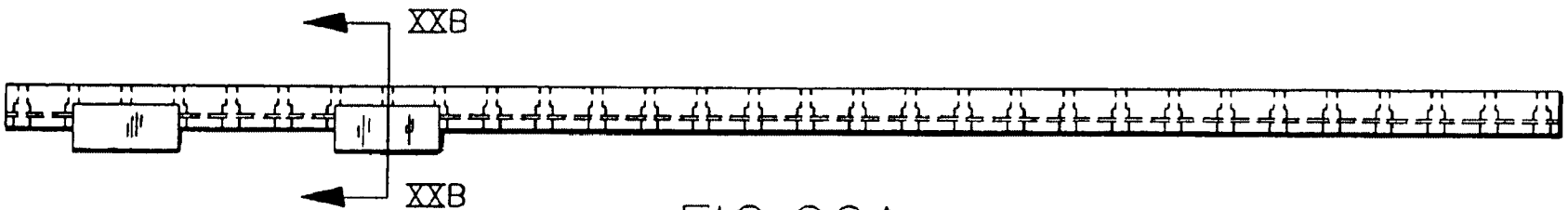
FIG. 20A is an enlarged view of a linear rail and guide.

As best seen in FIGS. 20A and 20B, each linear motion bearing assembly 25 includes a rail 25*a*, which is mounted to a respective horizontal member (20), and a plurality of bearings 25*b* that extend along both sides of rail 25*a* and on which guides 25*c* are mounted for linear movement along bearings 25*b* and, hence, rail 25*a*. Brackets 36 and 38 are mounted to bearing assemblies 25 by guides 25*c*, which support brackets 36 and 38 for linear movement along base 18.

Figure 20C:
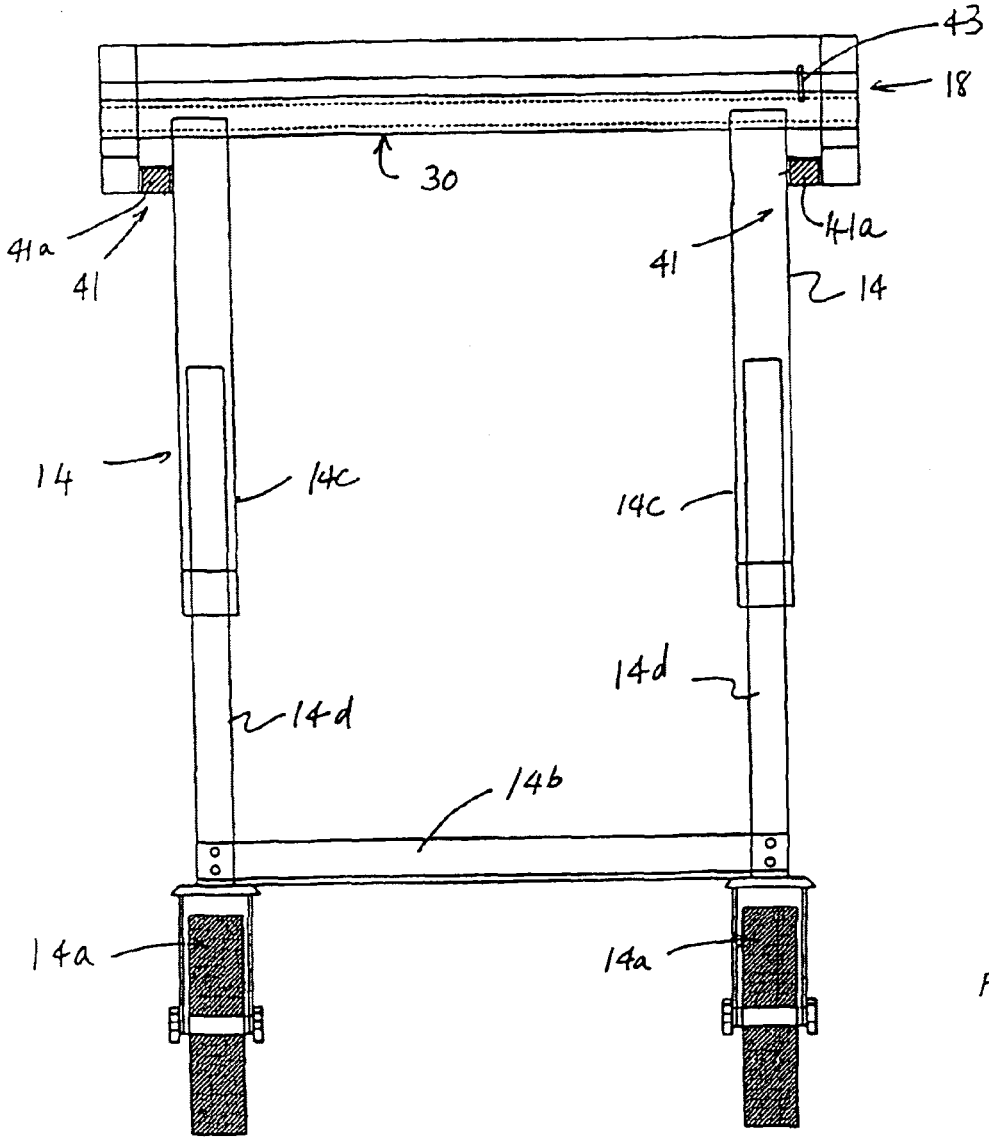
FIG. 20C is a rear elevation view of the undercarriage of FIG. 20 with several details removed to illustrate a rearward axial locking mechanism.
Figure 20D:
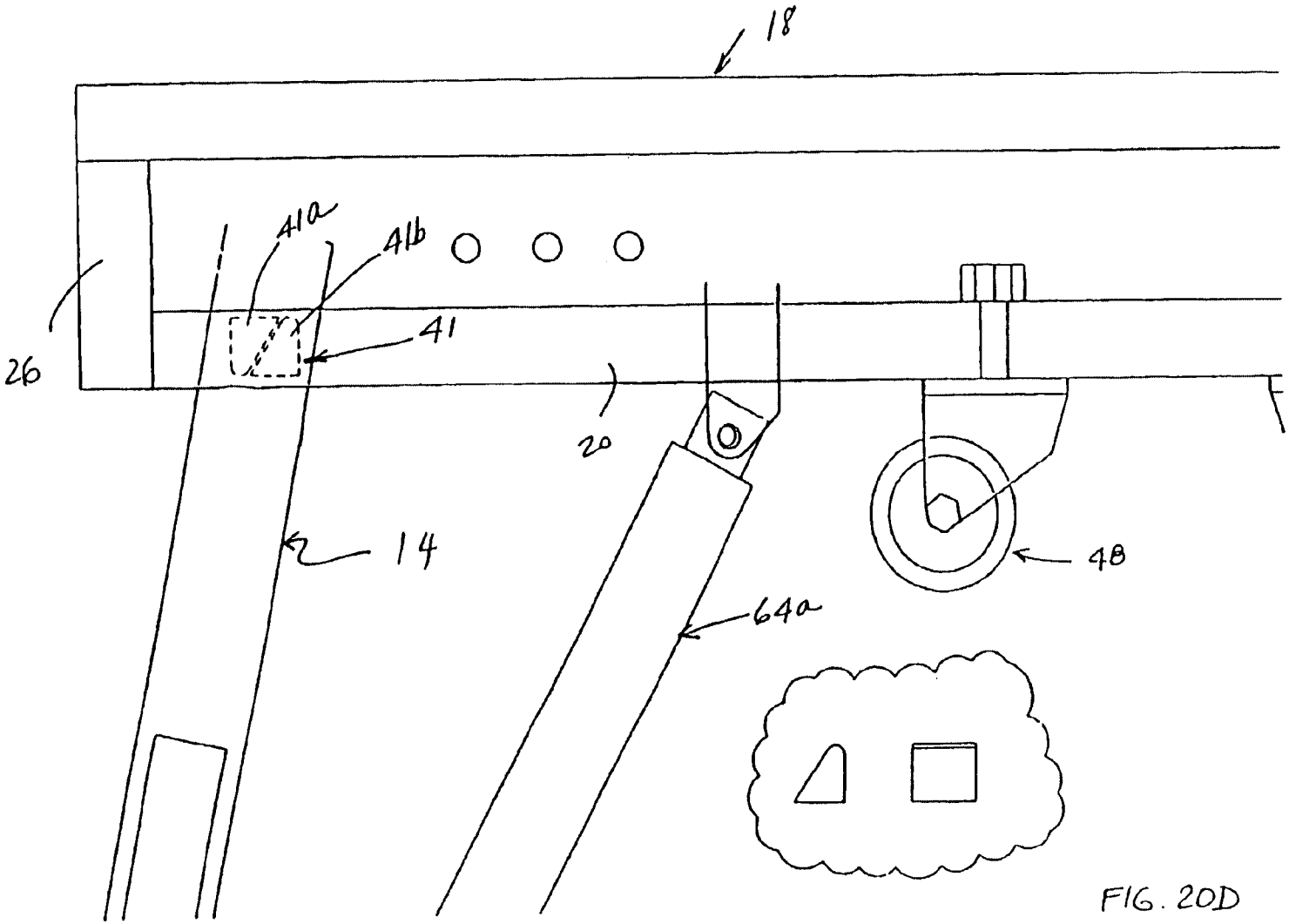
FIG. 20D is an enlarged side view of the rearward axial locking mechanism with several details removed for clarity.
Figure 22:
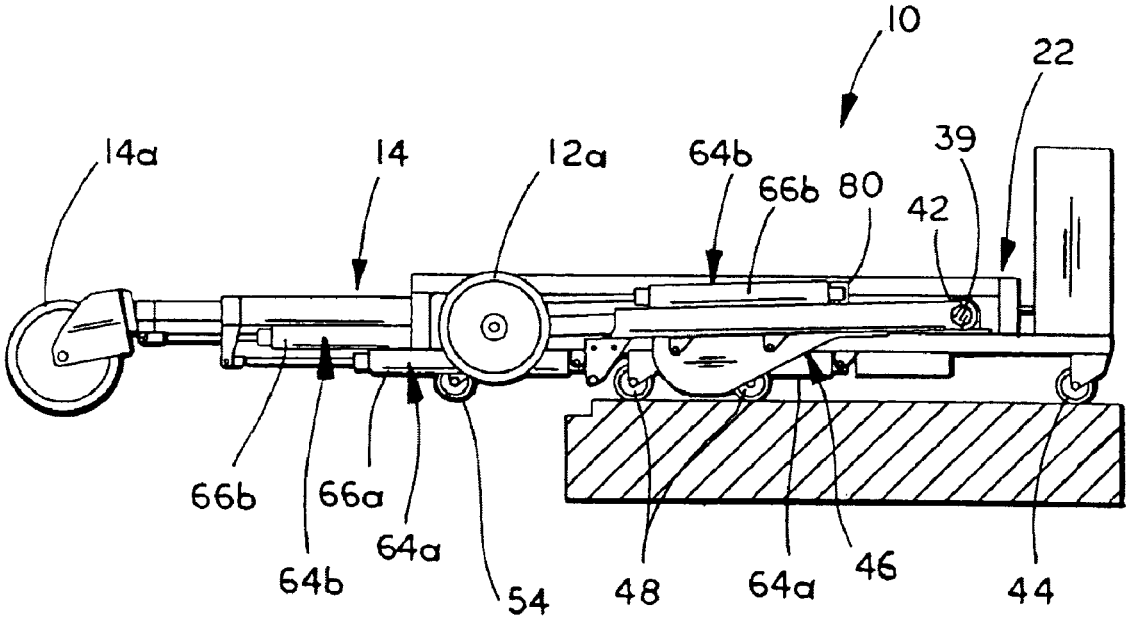
FIG. 22 is a similar view to FIG. 21 with the rearward wheels fully pivoted to their stowed position and the undercarriage partially loaded onto the support surface.
Figure 23:
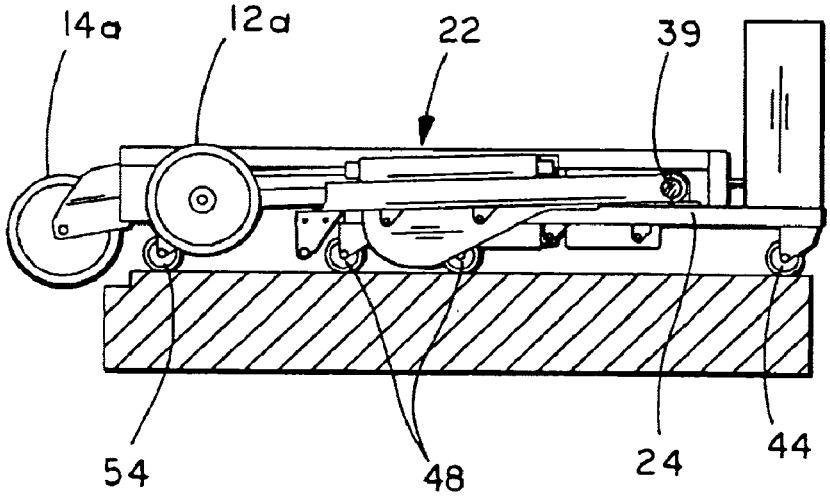
FIG. 23 is a similar view to FIG. 21 illustrating the undercarriage fully loaded onto the support surface.

In order to prevent brackets 36 and 38 from moving along support base 18 when rearward legs 14 are in their extended or supporting position, undercarriage 10 incorporates locking mechanisms 41 (FIG. 20C). As best seen in FIGS. 20C and 20D, each locking mechanism 41 includes a first stop 41*a*, which is mounted to the upper end of a respective rearward leg, and a second stop 41*b*, which is mounted to support base 18. Stops 41*a* and 41*b* make contact with each other when rearward legs 14 are extended and, thus, prevent the upper ends of legs translating linearly with respect to base 18. In addition, stops 41*a* and 41*b* prevent further rotation of legs in a counterclockwise direction (as viewed in FIG. 20) to thereby effectively lock legs 14 in position when they are rotated to their operative or supporting positions. In addition, control system 16 preferably includes a safety switch 43 to prevent activation of rearward legs 14 until axle 30 of rearward legs 14 is in its fully extended rearward position in base 18. Referring to FIGS. 20 and 20C, switch 43 is mounted to base 18 and positioned so that when axle 30 is moved to its fully extended rearward position, axle 30 will trigger switch 43. For example, switch 43 may comprise a limit switch or the like.

Figure 6:
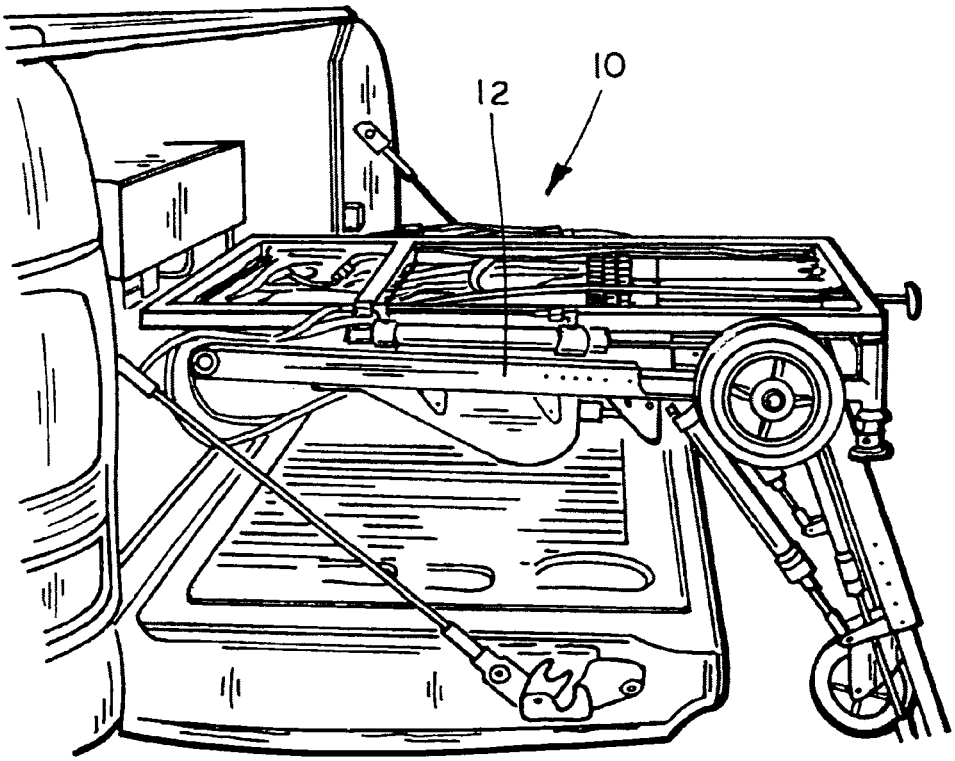
FIG. 6 is a similar view to FIG. 5 illustrating the forward legs fully pivoted to their stowed position.
Figure 7:
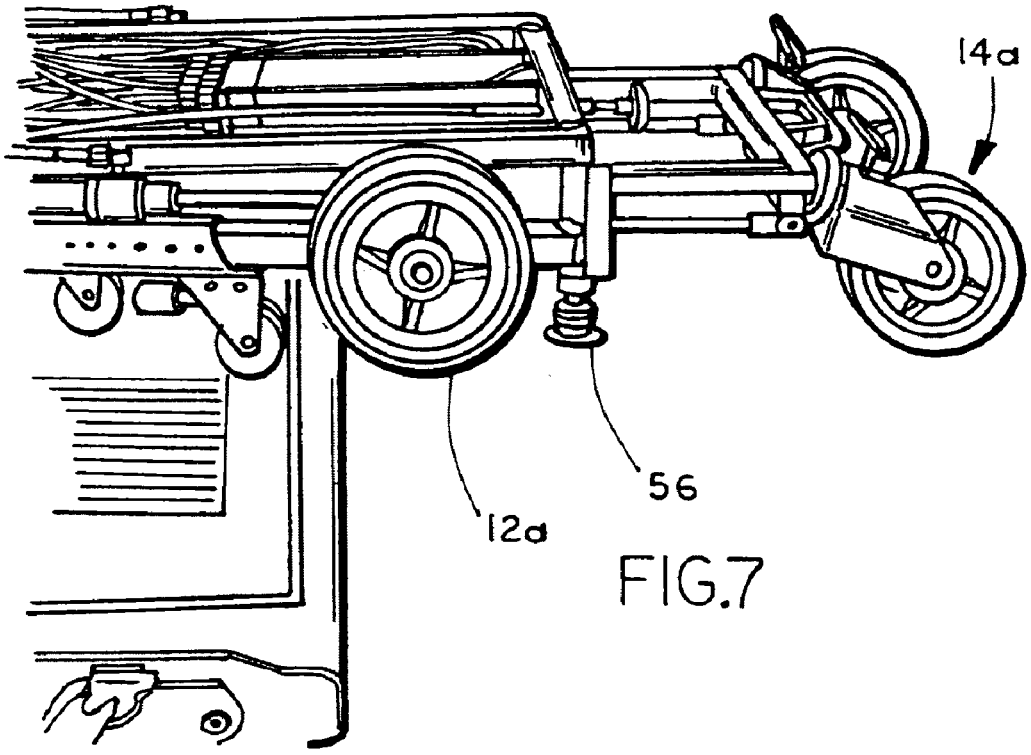
FIG. 7 is a similar view to FIG. 6 illustrating the rearward legs pivoted to their stowed position.

Forward legs 12 are similarly mounted at their proximal ends to a shaft axle 39, which is pivotally mounted to support base 18 by brackets 40 (FIG. 4) and 42 (FIG. 20), and are interconnected at a medial portion by a brace 12*b* (FIG. 1). Therefore, legs 12 similarly pivot in unison about the pivot axis 39*a* with shaft 39. Brackets 40 and 42 are mounted to horizontal members 20 of lower frame 24 at an opposed end of support base 18 from legs 14 to provide together with legs 14 wheeled support for support base 18. Brackets 40 and 42 comprise conventional C-shaped brackets with mounting flanges that are either bolted or welded to a respective horizontal member 20. Referring to FIGS. 6 and 8, when legs 12 are fully pivoted to their stowed position, legs 12 lie in a plane generally parallel to horizontal members 20 of support base 18 between upper and lower frames 22 and 24 but adjacent frames 22 and 24 and, further, between the upper plane bounded by the upper surface of upper frame 22 and the lower plane bounded by the lower surface of lower frame 24, with the exception of the journaled member that may be of a size to project below the lower frame 22.

Figure 5:
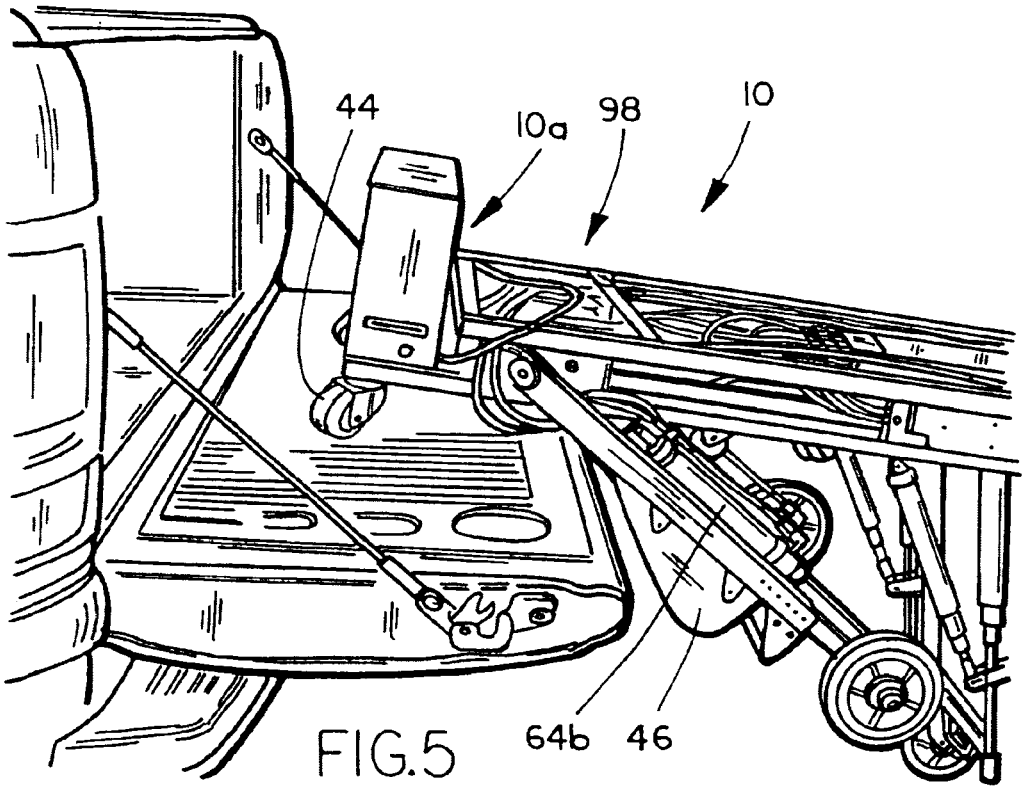
FIG. 5 is a side perspective view of the undercarriage of FIG. 1 being loaded onto a vehicle illustrating the forward legs pivoting to a stowed position.
Figure 21:
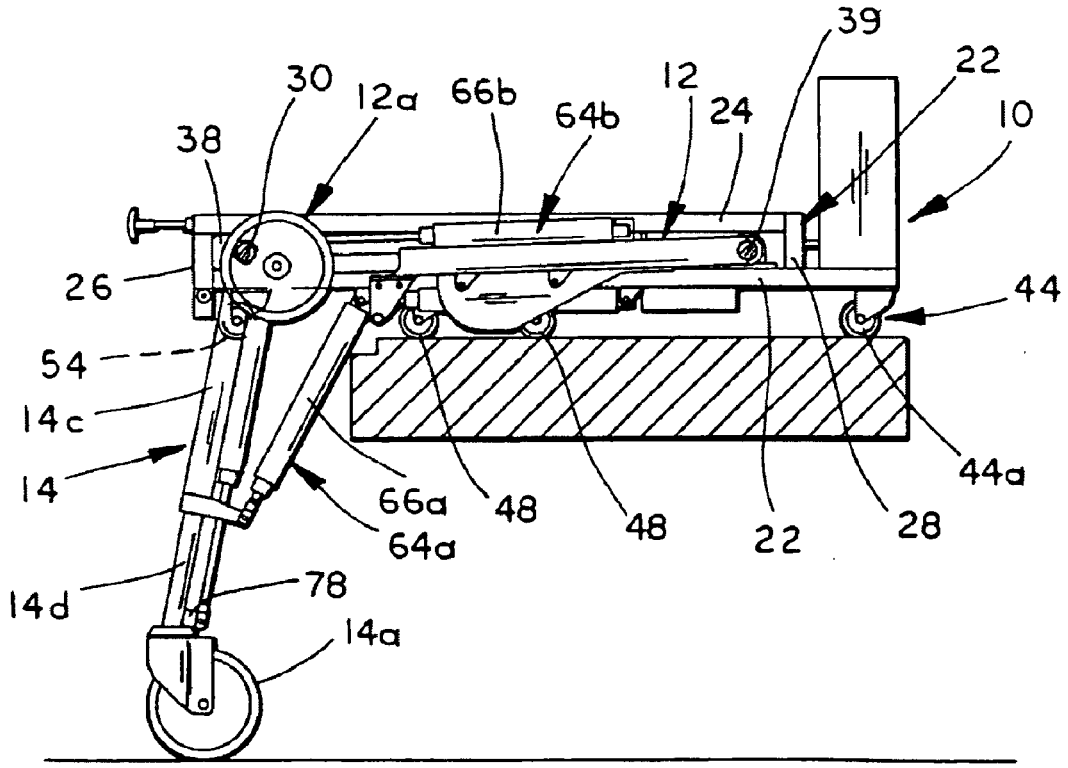
FIG. 21 is a side elevation view of the undercarriage of FIG. 20 illustrating the undercarriage being loaded onto a support surface with the forward wheels being pivoted to a stowed position.

As best understood from FIGS. 5 and 21, to transfer undercarriage 10 onto a support surface, such as the floor of vehicle, including a helicopter, forward portion 10*a* of the undercarriage is first moved toward the support surface so that it extends over the support surface. The forward portion of support base 18 includes front or forward journaled guide members 44, such as wheels, rollers, casters or the like, that are mounted to the horizontal members 20 of lower frame 24, preferably with a swivel mount. Once guide members 44 are resting on the support surface, the forward legs 12 may then be pivoted. As the forward legs pivot, the undercarriage can be pushed onto the support surface from the rear end of the undercarriage. This can be managed by one person, unlike the prior art devices. To facilitate the further rotation of the front legs, front legs 12 include flanges or cam members 46 that act as a guide when they contact the support surface and apply an upward force to the front legs as the undercarriage is pushed on to the support surface. Flanges or cam members 46 are preferably formed from low friction material, such as plastic plates, that are mounted to the respective upper tubular members of the forward legs and are oriented to face forward toward the support surface. As the forward legs continue to pivot, the person handling the undercarriage can continue to urge the undercarriage forward on to the support surface.

Figure 14:
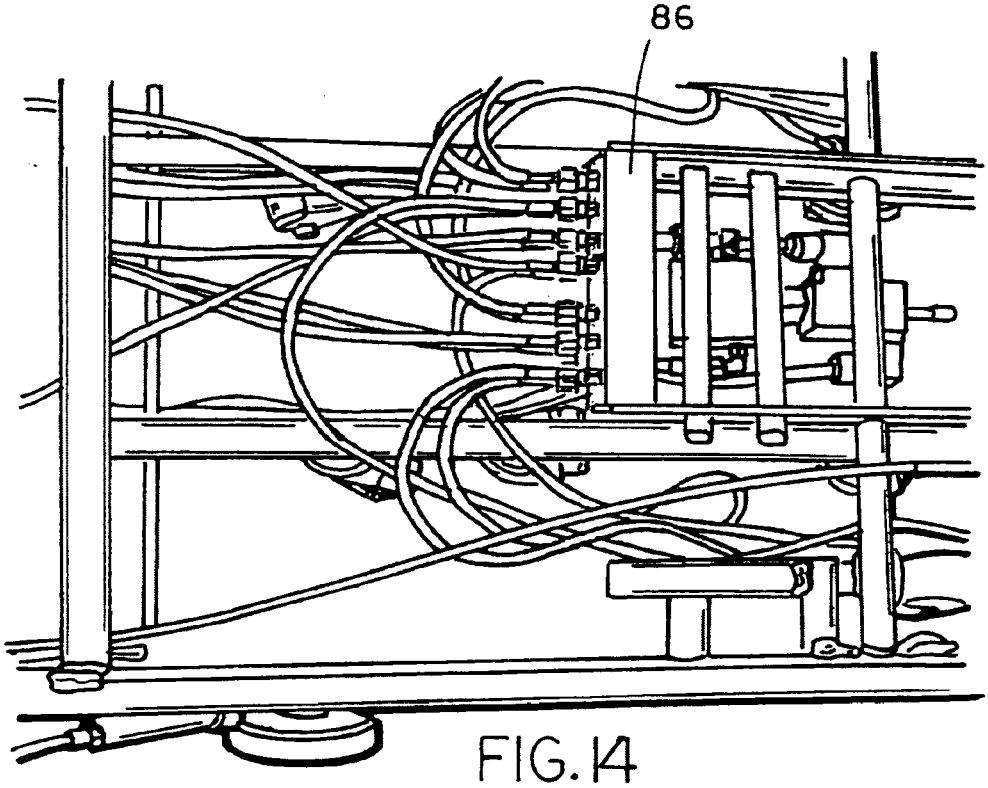
FIG. 14 is a partial plan view of the undercarriage of FIG. 1 illustrating the mounting arrangement of the control system and intermediate support wheels.
Figure 15:
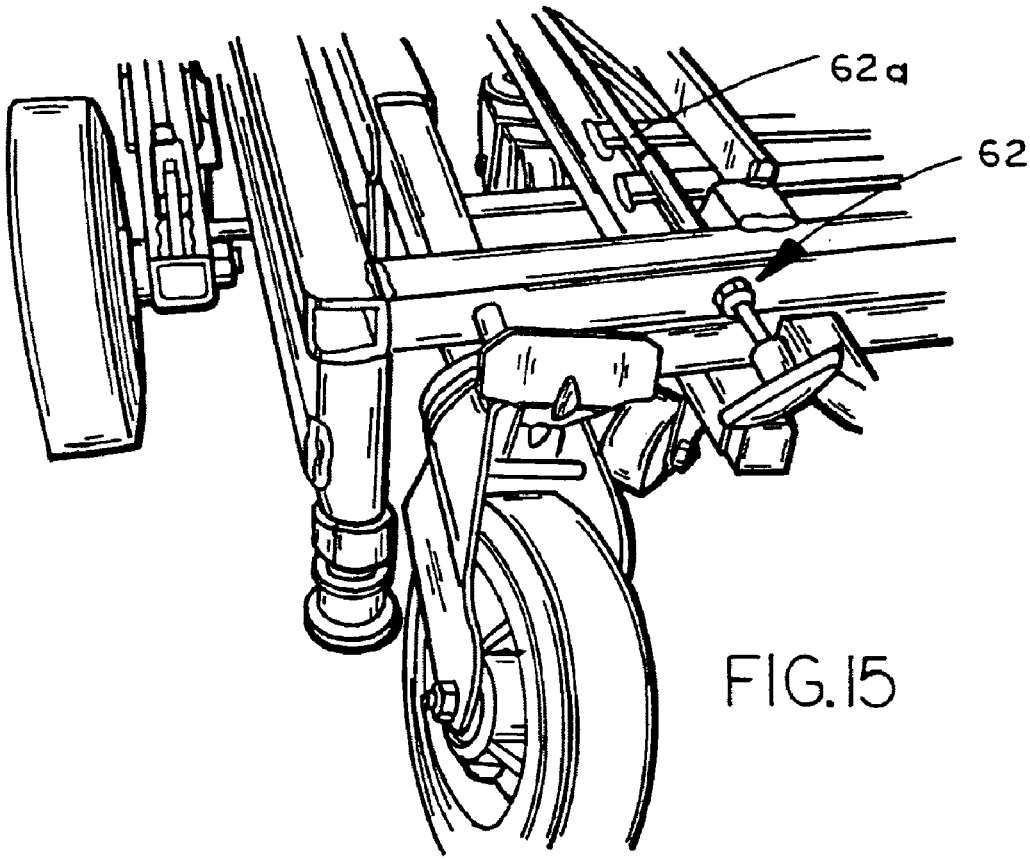
FIG. 15 is an enlarged rear end perspective view of the telescoping arrangement of the forward and rearward legs of the undercarriage of FIG. 1.
Figure 16:
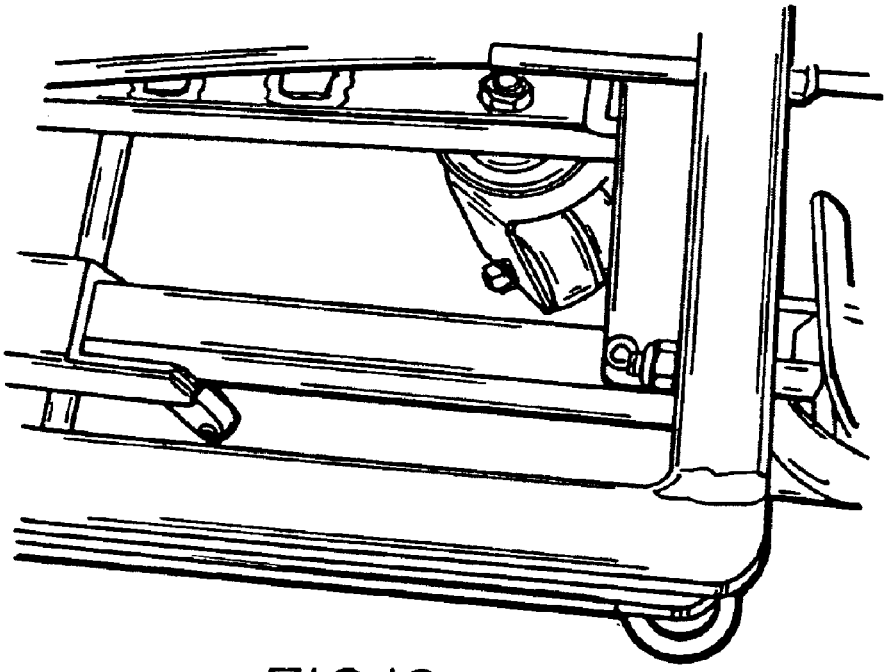
FIG. 16 is an enlarged plan view of the telescoping arrangement of the rearward legs of the undercarriage.
Figure 17:
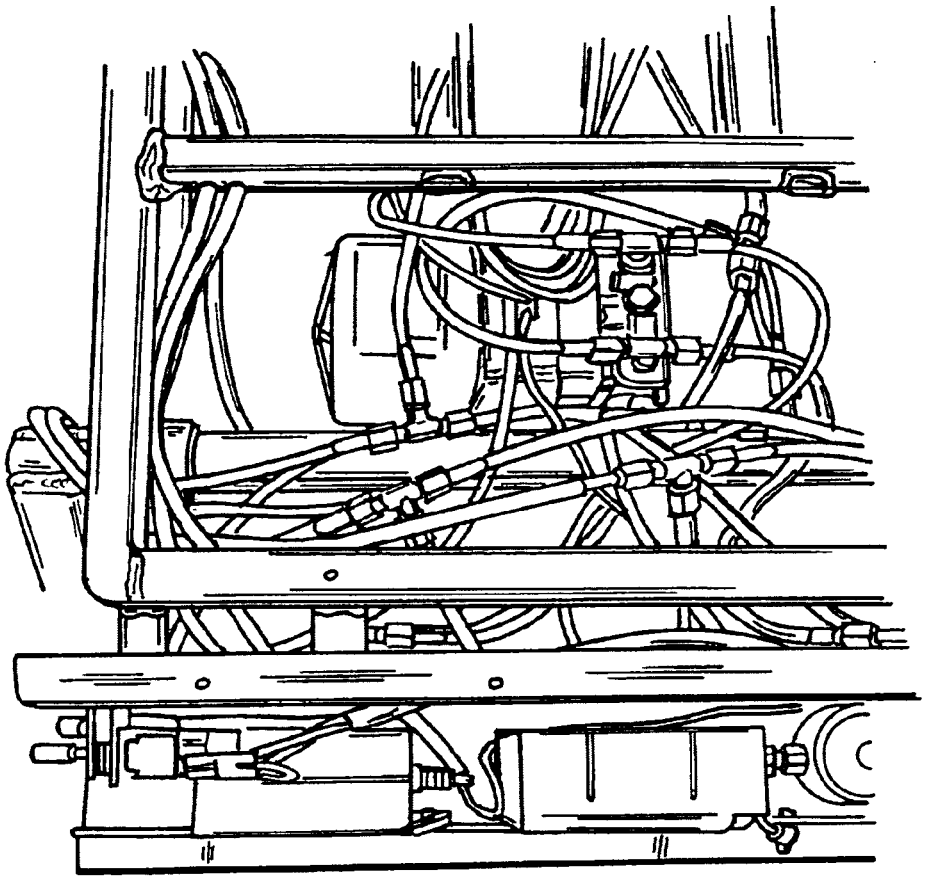
FIG. 17 is an enlarged partial plan view of the mounting arrangement of the control system of the present invention.
Figure 19:
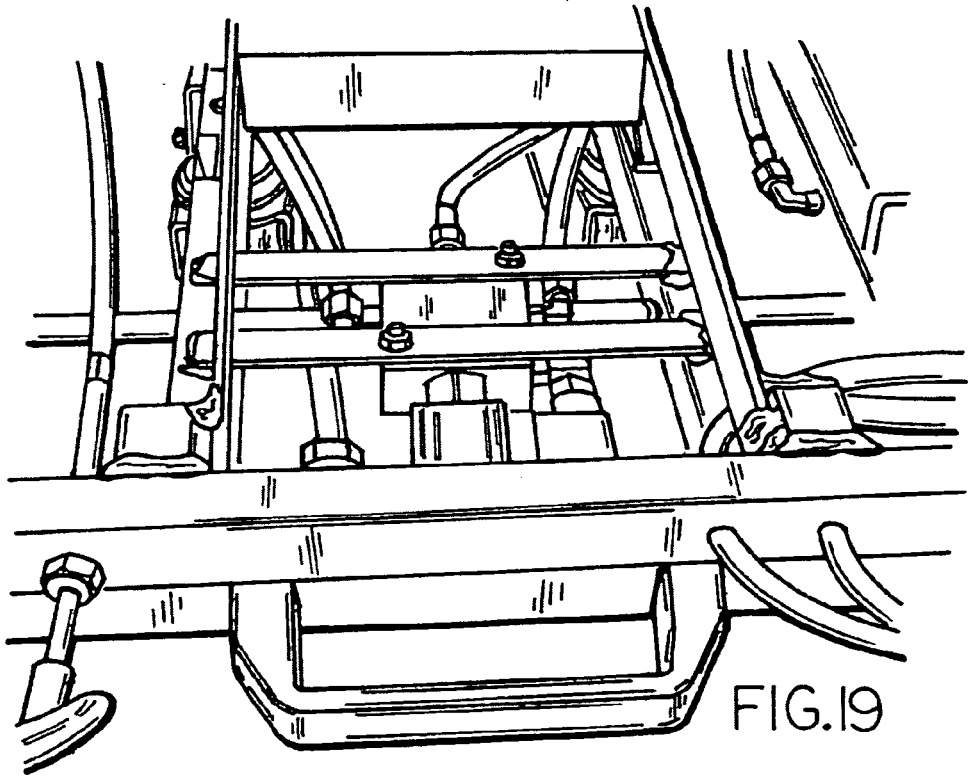
FIG. 19 is another enlarged partial perspective view of the mounting arrangement of the control system of the present invention.
Figure 18:
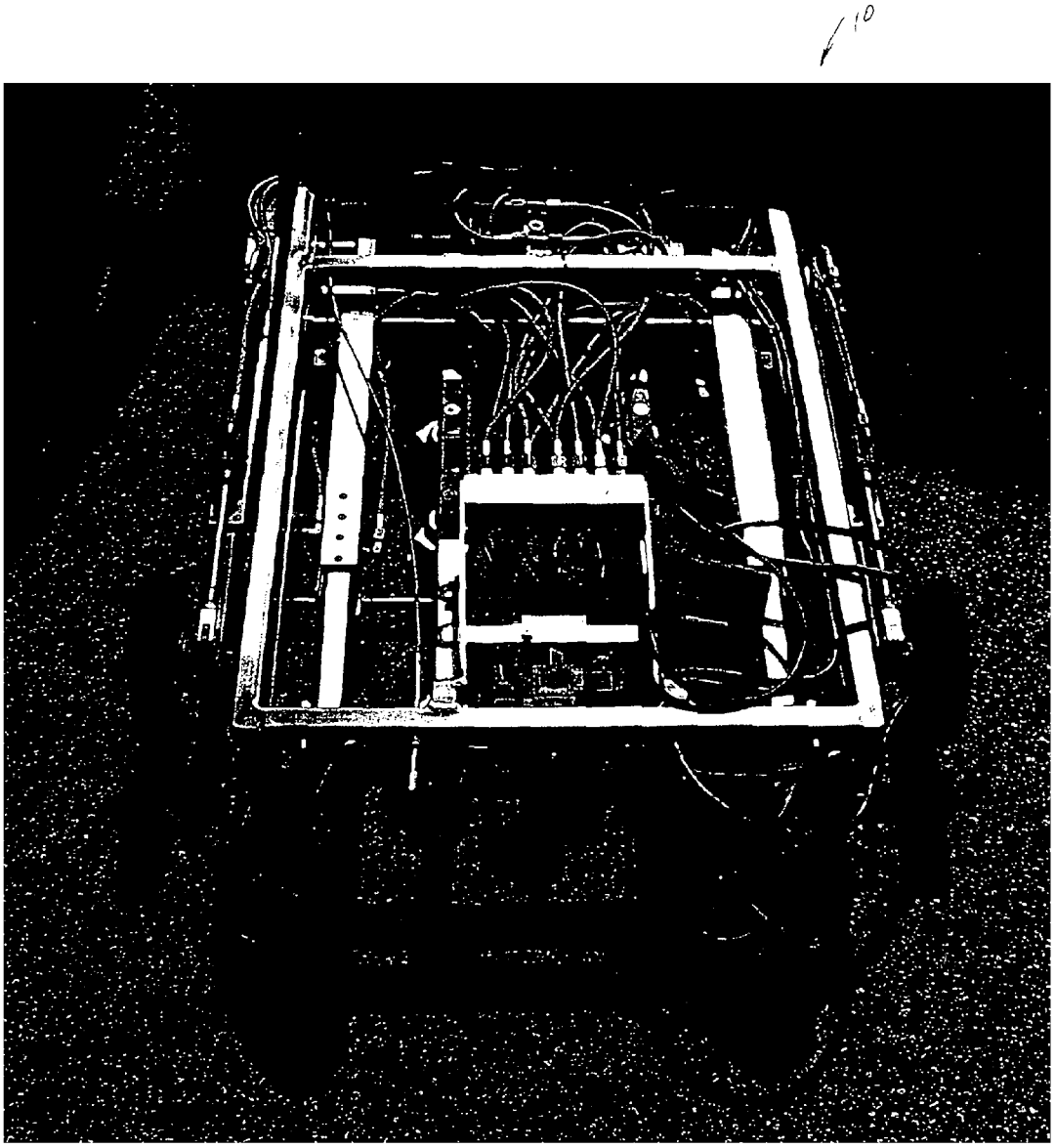
FIG. 18 is an enlarged partial perspective view of the mounting arrangement of the control system of the present invention.

To ease on-board maneuvering of undercarriage 10, support base 18 is provided with a set of intermediate journaled guide members 48. In addition, intermediate journaled guide members 48 assist in the transferring of the weight of the undercarriage onto the support surface to further ease in the handling and maneuvering of the undercarriage onto the support surface. As best seen in FIGS. 8 and 14, intermediate journaled guide members 48 are mounted to intermediate horizontal members 20*a* (FIG. 8) forming lower frame 24 and, similar to the forward journaled guide members 44, are preferably swivel mounted to support base 18. Preferably, the center of gravity 50 (FIG. 20) of undercarriage 10 is at least at or near the center 52 of intermediate journaled guide members 48 or, more preferably, at least slightly forward of members 48 to further ease the handling and maneuvering of undercarriage 10.

Figure 24:
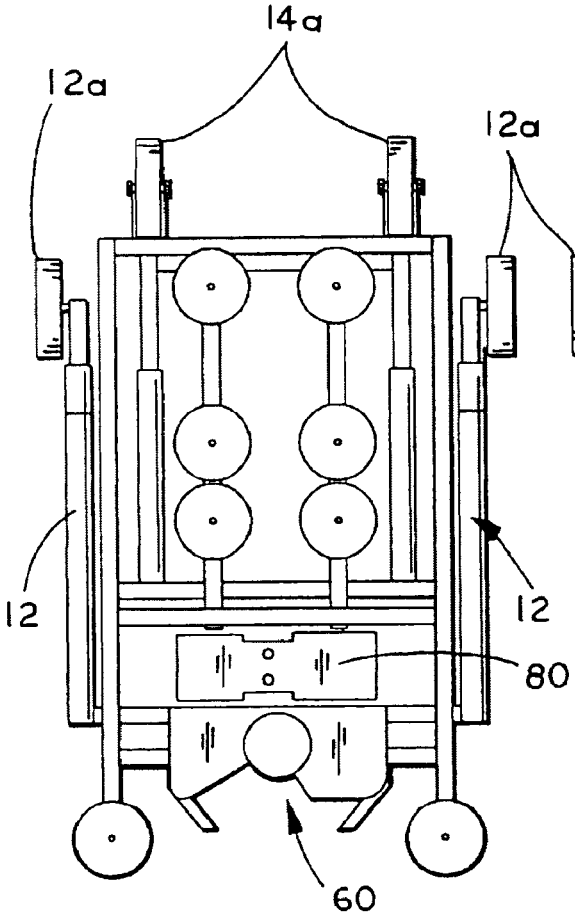
FIG. 24 is a plan view of the undercarriage of FIGS. 20–23 illustrating the forward legs pivoted to their stowed position.
Figure 25:
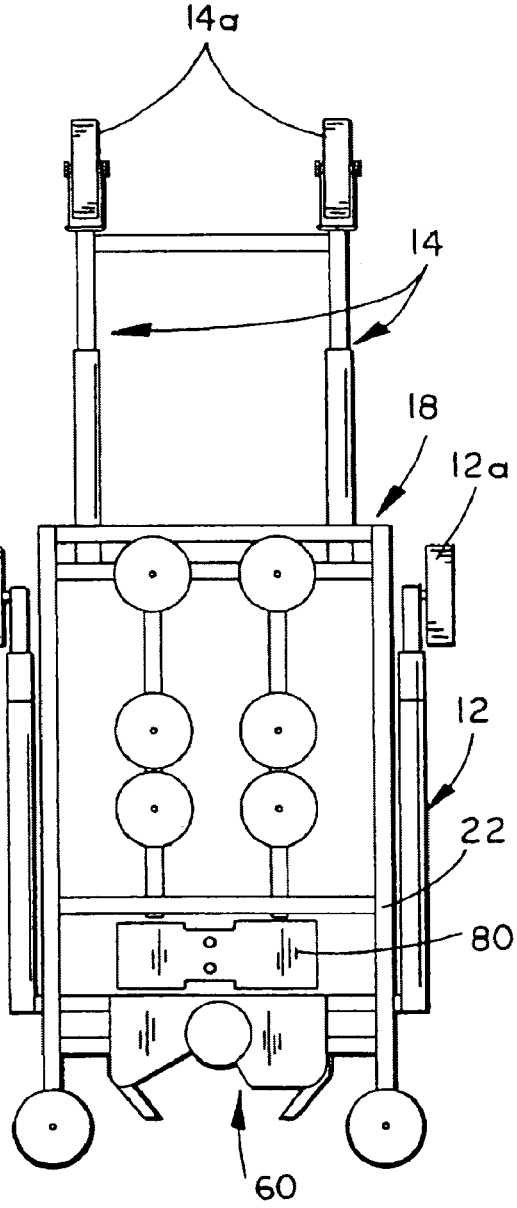
FIG. 25 is a similar view to FIG. 24 illustrating the forward legs and rearward legs pivoted to their stowed position.
Figure 26:
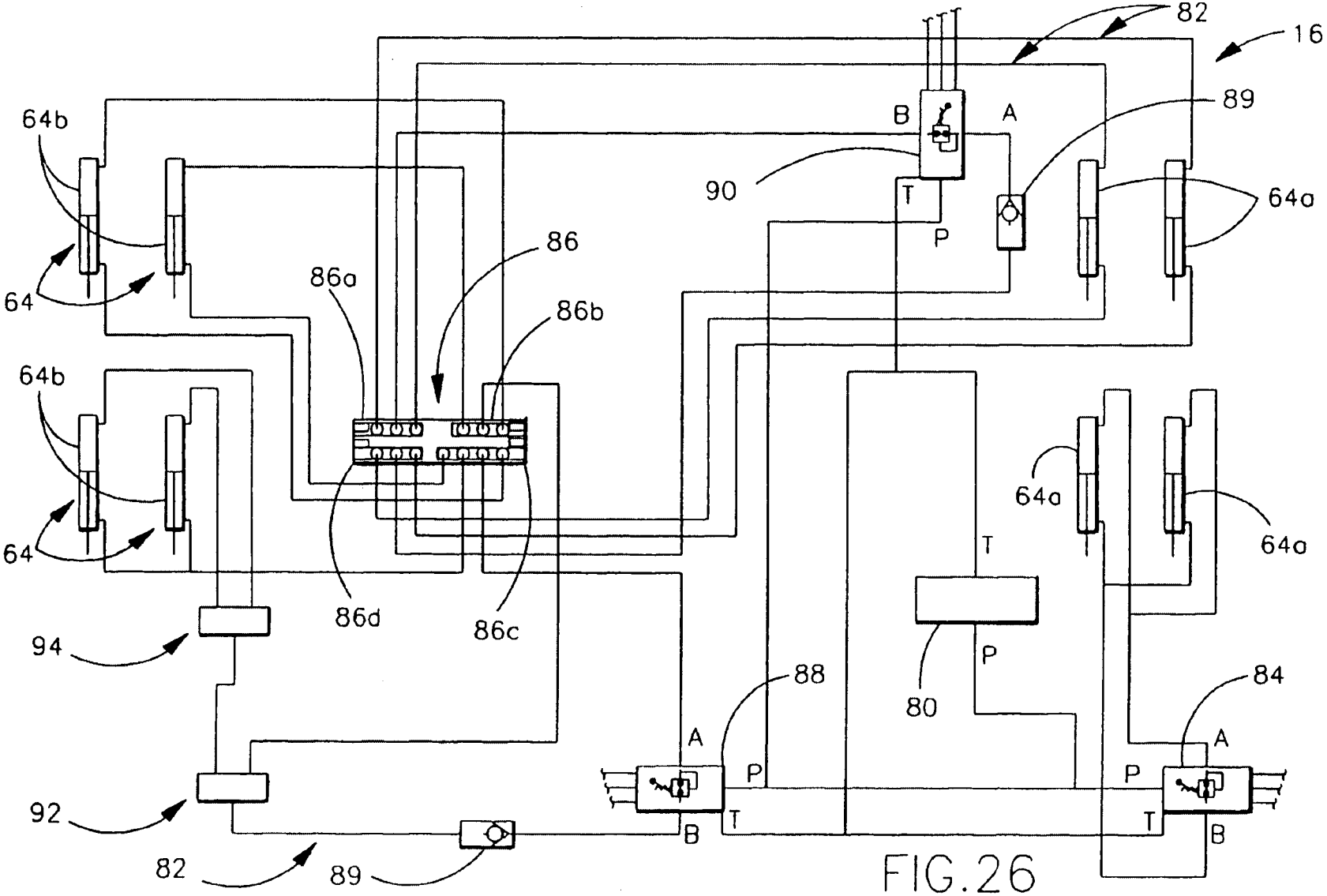
FIG. 26 is a schematic view of the control system of the undercarriage of the present invention.

In addition, the rear end portion 10*b* of under carriage 10 includes a pair of journaled members 54, such as wheels, rollers, casters, or the like, mounted to support base 18 that provide support for the rear end of the undercarriage to further facilitate handling of the undercarriage. Optionally, rear end 10*b* also includes fixed supports or stanchions 56, preferably that are vertically adjustable, so that when undercarriage in a desired position on the support surface, they can be lowered to fix the position of the rear end of the undercarriage. To fix or anchor the forward portion of the undercarriage, forward portion includes a locking mechanism 60 (FIGS. 24 and 25) that is adapted to engage, for example, an anchor structure, such as a post, that is mounted to the floor of the vehicle. In a helicopter, the floor of the helicopter typically includes a cylindrical post that is anchored to the floor. In this manner, when the locking mechanism is engaged with and locked on to the post, the undercarriage is securely tied down in the helicopter.

Figure 28:
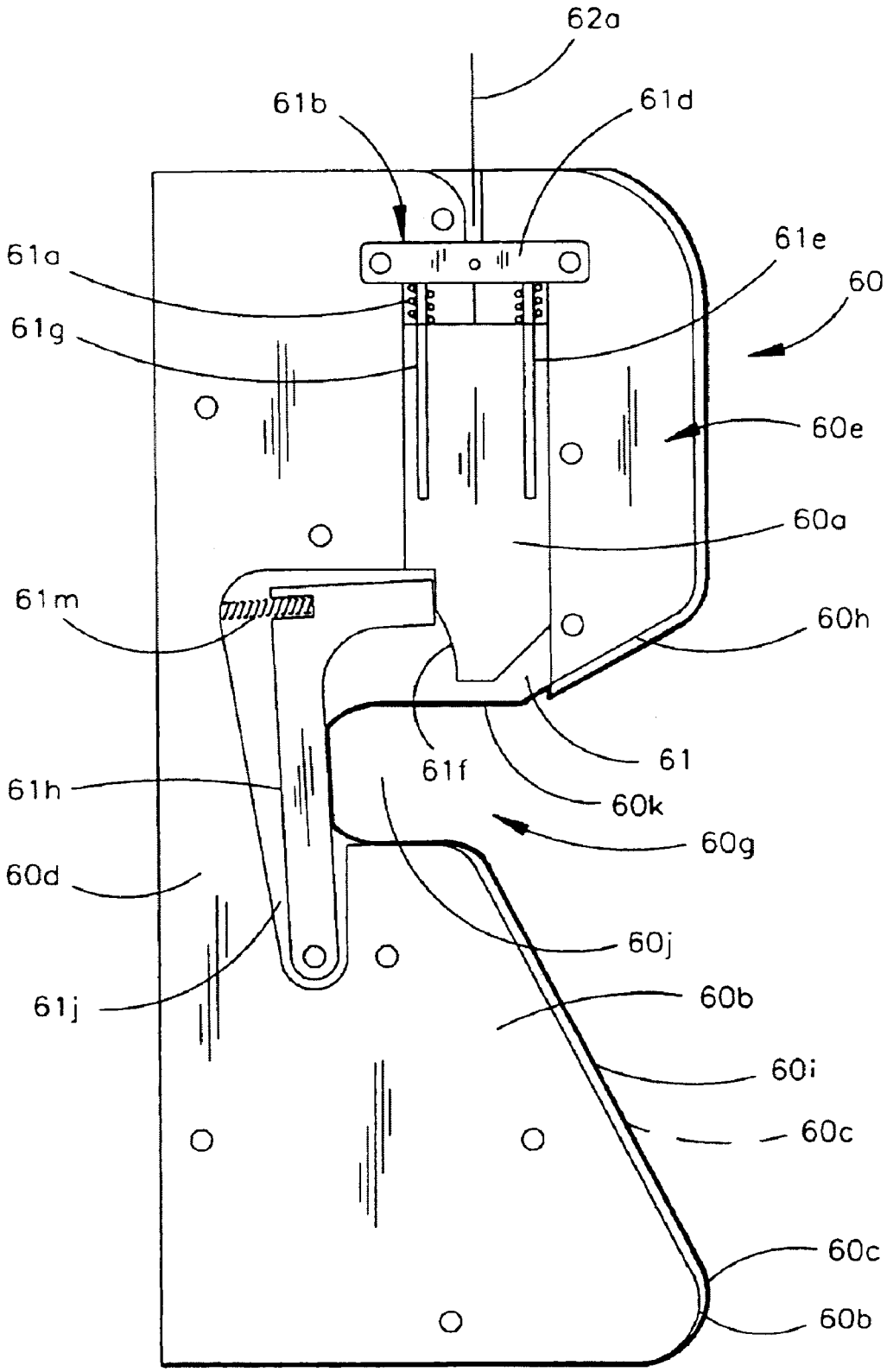
FIG. 28 is an enlarged plan view of the locking mechanism of the undercarriage.
Figure 29:
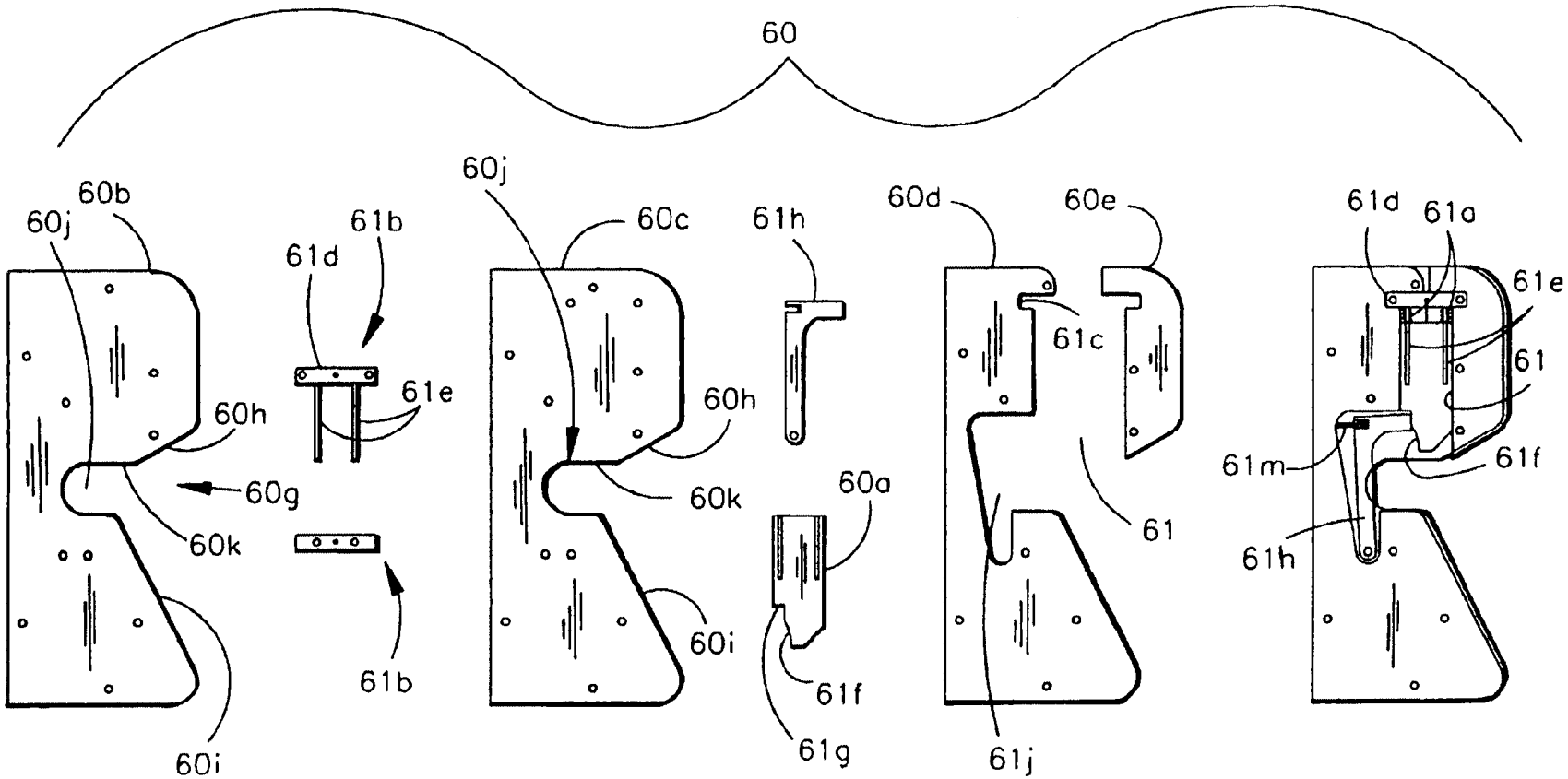
FIG. 29 is an exploded plan view of the locking mechanism of FIG. 28.

Referring to FIGS. 28 and 29, locking mechanism 60 includes a locking arm 60*a* that is actuated in to a locked position about the anchor structure when locking mechanism 60 is urged into engagement with the anchor structure. Arm 60*a* is released from its locked position upon actuation by a handle and cable assembly 62 (FIG. 2), which is preferably located at the rear end 106 of undercarriage 10. As best seen in FIG. 29, locking mechanism 60 includes upper and lower plates 60*b* and 60*c* and intermediate plates 60*d* and 60*e* that are sandwiched between upper an lower plates 60*b* and 60*c*. Plates 60*b* and 60*c* are preferably formed form a rigid material, such as metal, and, more preferably, from a light weight metal, such as aluminum. Intermediate plates 60*d*, 60*e* may be formed from a plastic material, such as ultra high molecular weight plastic, to thereby reduce the friction of the moving parts of locking mechanism 60 and are attached to upper and lower plates by fasteners or the like. In addition, plates 60*d* and 60*e* each have a greater thickness than either plate 60*b* or 60*c* so as to form a gap between plates 60*b* and 60*c* of sufficient height to house arm 60*a* and the various components described below, which are used to actuate arm 60*a*.

Each plate 60*b* and 60*c* has formed therein a recessed portion 60*g* that is preferably generally centrally located on one side of the respective plate. Recessed portion 60*g* includes angled walls 60*h* and 60*i* that guide the anchor structure, which is preferably a post, into a seat 60*j* that is formed at the juncture of the two angled walls. In the illustrated embodiment, seat 60*j* has a circular perimeter and a shoulder 60*k*; though it should be understood that the shape of the seat may be varied. As will be more fully described, when the anchor structure is moved into seat 60*j*, arm 60*a* is released and moved to its locked position behind the anchor structure to thereby lock onto the anchor structure.

As noted above, intermediate plates 60*d*, 60*e* are spaced apart and define therebetween a space or passageway 61 in which arm 60*a* is positioned and movably supported for extension into seat 60*j* though shoulder 60*k* so that when the anchor structure is positioned in seat 60*j* and arm 60*a* is moved to its extended position, arm 60*a* will lock undercarriage 10 onto the anchor structure until the arm 60*a* is released. As previously note, arm 60*a* is movably supported in the passageway defined between plates 60*d*, 60*e* and, further, is urge to its extended or locked position by springs 61*a*. Springs 61*a* are supported on a guide 61*b* that is mounted between plates 60*d*, 60*e* and located in corresponding recesses 61*c* that align guide 61*b* in passageway 61. Guide 61*b* includes a transverse member or base 61*d* that extends between recesses 61*c* and further supports a pair of guide pins 61*e* that extend into corresponding elongate recesses formed in arm 60*a* to provide a linear guide for arm 60*a*. Springs 61*a* are mounted on pins 61*e* and are compressed between transverse member 61*d* and the proximal end of arm 60*a* so that arm 60*a* is urged toward seat 60*j*. The distal end of arm 60*a* includes an engagement surface 61*f*, which optionally matches the surface topology of the anchor structure to reduce the play between the anchor structure and the locking mechanism. In the illustrated embodiment, engagement surface 61*f* is a curved surface to match the curved surface of the anchor structure. In addition, the distal end of arm 60*a* includes a shoulder 61*g* that is used to latch arm in its retracted position.

As best seen in FIG. 28, locking mechanism 60 includes a second arm 61*h* that is used to latch arm 60*a* in its retracted position and, further as will more fully explained below, to actuate arm 60*a* to move to its extended position. Second arm 61*h* is pivotally mounted between upper and lower arms 60*b* and 60*c* by a pin and is positioned in an inverted generally L-shaped passage 61*j* (as viewed in FIG. 29) formed in plate 60*d*. In addition, arm 61*h* is urged by a spring 61*m* to a pivoted position in which the distal end of arm 61*h* projects into passage 61 to engage shoulder 61*g* of arm 60*a* to thereby latch arm 60*a* in its retracted position. Spring 61*m* is mounted on one end to plate 60*d* and extends into and is captured in a recess formed in arm 61*h*. In its rested state, arm 61*h* is extended into passage 61, but is moved to its retracted position in passage 61*j* when compressed by the anchor structure. When moved to its retracted position, arm 61*h* disengages from arm 60*a* to thereby release arm 60*a* so that arm 60*a* can be extended behind the anchor structure to thereby lock undercarriage onto the anchor structure. Arm 60*a* is unlocked when cable 62*a* is tensioned sufficiently to move arm 60*a* against the force of springs 61*a*.

As previously noted, legs 12 and 14 are pivoted to their stowed positions and, further, are actuated to extend in length by control system 16. Control system 16 comprises a remote control system in that the actuators that impart the rotation and lengthening of the respective legs are controlled by controllers remote from the actuators, though the remote controllers are preferably mounted on the undercarriage or to the stretcher base. In the illustrated embodiment, control system 16 comprises a hydraulic system, which enables both pairs of legs to independently extend and retract for raising and lowering the support base 18 for raising and lowering a patient's position, as well as pivot about their respective pivot axes for loading the undercarriage onto a vehicle. As best seen in FIGS. 2, 3, 4, and 26, control system, 16 includes a plurality of actuators 64. Optionally, each leg 12, 14 includes two actuators—a pivot actuator 64*a* for pivoting the respective leg and a height adjustment actuator 64*b* for lengthening or shortening the respective leg. Each rearward leg 14 includes a mounting flange or tab 66 to which the distal end of pivoting actuator 64*a* is mounted. In the case of the rearward legs, the distal ends of the pivoting actuators are mounted to brace 12*b* and the proximal ends of pivoting actuators 64*a* are mounted to the respective brackets 32 and 34.

Figure 12:
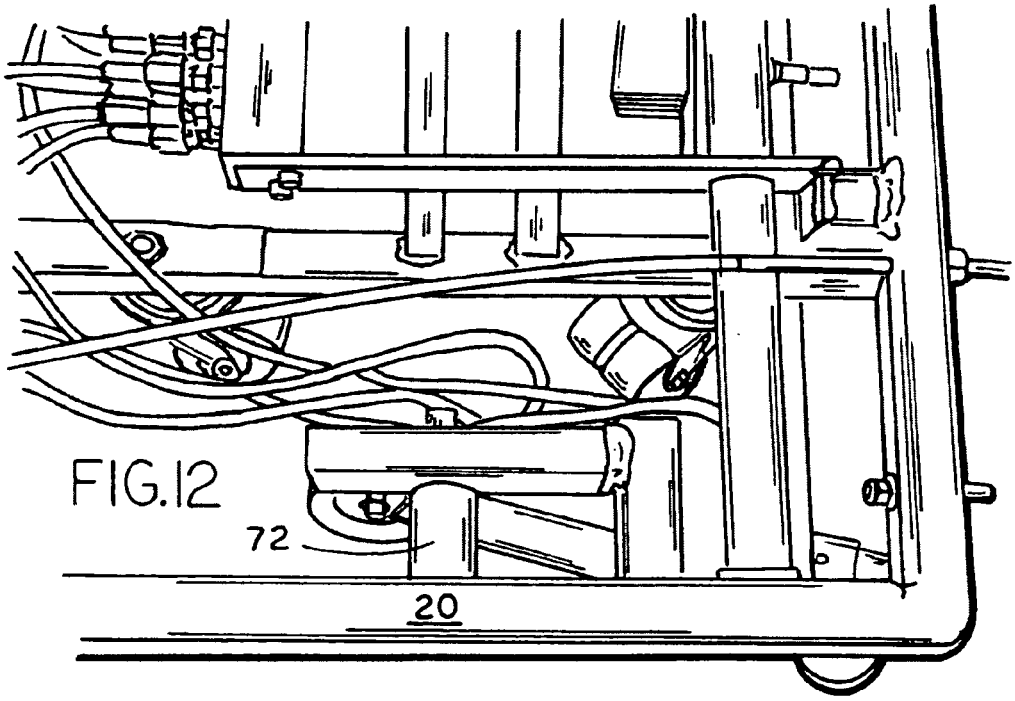
FIG. 12 is an enlarged partial plan view illustrating the mounting arrangement of the control system of the undercarriage.
Figure 13:
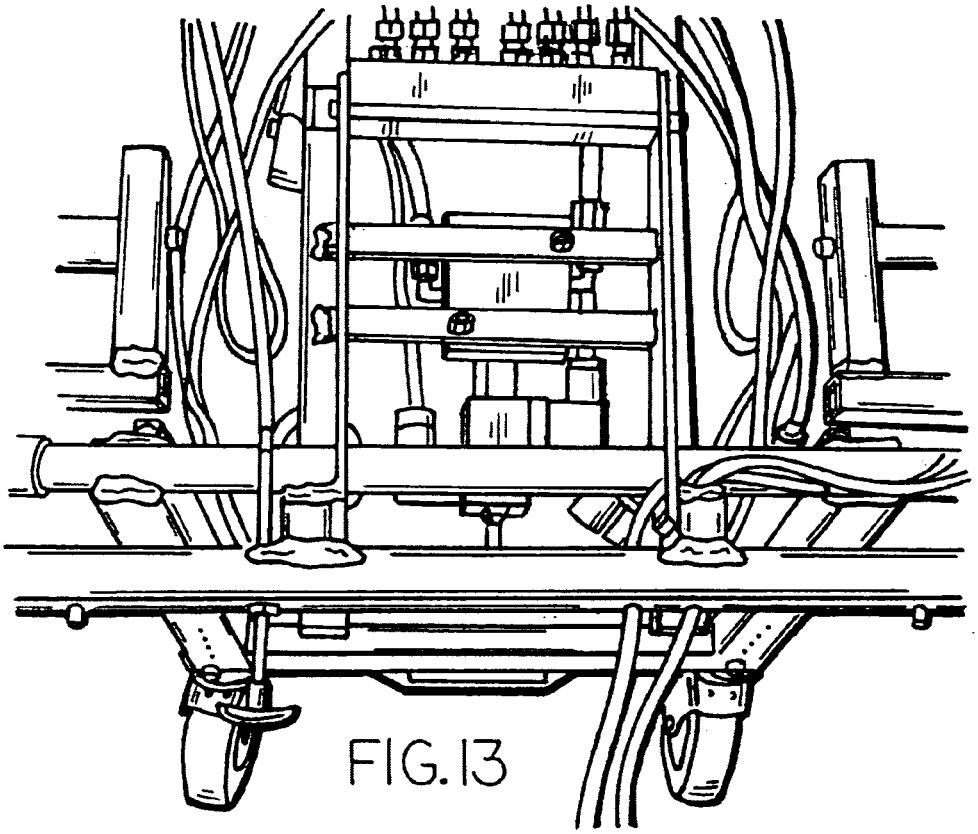
FIG. 13 is an enlarged partial plan view of the mounting arrangement of the control system, the rearward legs, and a release mechanism of the present invention.

As best seen in FIG. 12, each bracket 32, 34 includes mounted thereto a support that extends inwardly from horizontal members 20 of lower frame 24 and forward of pivot shaft 30 of rearward legs 14. The distal ends of pivot cylinders 64*a* of rearward legs 14 are mounted to brackets 34 and 36 at supports 72 by brackets 74. Thus, in the case of the rearward legs 14, pivot actuators 64*a* are extended to pivot the rearward legs to their pivoted positions. With respect to pivot cylinders 64*a* of the forward legs 12, the proximal ends of pivot cylinders 64*a* are mounted to horizontal members 20 of lower frame 24 by brackets 70, which are directly mounted to the lower frame 24 but mounted rearward of legs 12. Thus in the case of the forward legs, pivot actuators 64*a* are retracted to pivot the respective front legs to their pivoted and also stowed positions. In the illustrated embodiment, supports 72 comprise tubular L-shaped members; however it should understood that supports 72 may have other configurations.

In the illustrated embodiment, each leg 12, 14 comprises a telescoping leg, with an outer tubular member 12*c*, 14*c* and an inner tubular member 12*d*, 14*d*. For example, the inner tubular members may be mounted inside the respective outer tubular members on bearings, which permit extension and retraction of the inner tubular member relative to the outer tubular member while maintaining the relative play between the two members at acceptable levels, as would be known in the art. Height adjustment actuators 64*b* are mounted at their distal ends to inner tubular members 12*d*, 14*d*, while their proximal ends are mounted to the respective outer tubular members 12*c*, 14*c* to permit adjustment of the length of the respective legs. Preferably, the respective outer and inner tubular members of the legs are provided with tabs or mounting flanges 78, 80 to which the height adjustment actuators 64*b* are mounted. In this manner, when a height adjustment actuator 64*b* is extended, inner tubular member 12*d*, 14*d* is extended with respect to the outer tubular member 12*c*, 14*c* to thereby lengthen the respective leg. Optionally, pivot actuators 64*a* and adjustment actuators 64*b* may be independently controlled so that each leg can be independently adjusted. However to minimize potential for binding and for ease of control, pivot actuators 64*a* of forward legs are actuated together, and pivot actuators 64*a* of rearward legs 14 are actuated together. Similarly, to maintain support base 18 level, adjustment actuators of both pairs of legs are preferably actuated together. However, it should be understood that control system 16 may be configured to adjust each leg independently.

In the illustrated embodiment, pivot actuators 64*a* and adjustment actuators 64*b* comprise cylinders and preferably hydraulic cylinders 66*a* and 66*b*. Preferably cylinders 66*a* and 66*b* are double acting cylinders and are connected to a pump and tank 80 through tubes or conduits 82, which deliver and receive hydraulic fluid from pump and tank 80 to the respective cylinders to thereby selectively extend or retract the rod end of the respective cylinders to control the position and/or length of the respective legs. Hydraulic fluid is delivered from the tank through the pump to pivot cylinders 64*a* of rear legs 14 through a control valve, preferably a solenoid valve 84. Pump and tank 80 also deliver fluid to pivot cylinders 64*a* of front legs 12 and the adjustment cylinders 64*b* of both front and rear legs 12, 14 though a manifold 86 and a pair of solenoid valves 88 and 90, which are connected in parallel to manifold 86, to deliver fluid to the respective cylinders. Solenoid valves 84, 88, and 90 preferably comprise double directional solenoid valves so that the hydraulic fluid can flow either way through the solenoid valve to permit delivery of fluid to either end of the respective double-acting cylinder. In the illustrated embodiment, manifold 86 has four chambers or compartments—one compartment 86*a* for delivering to or receiving hydraulic fluid from one end of pivot cylinders 64*a* for the front legs 12; a second compartment 86*b* for delivering to or receiving hydraulic fluid from one end of the adjustment cylinders 64*b* of the front legs 12; a third chamber 86*c* for delivering to or receiving hydraulic fluid from the other end of the pivot cylinders 64*a* of the front legs 12; and a fourth chamber for delivering to or receiving hydraulic fluid from the other ends of the adjustment cylinders 64*b* of both the front and rear legs 12, 14. In addition, control system 16 includes a pair of flow dividers 92 and 94 to hydraulically couple the front and rear adjustment cylinders together and to hydraulically couple the left and right adjustment cylinders together to assure that the support base moves up and down evenly. Solenoid valve 88 directs the hydraulic fluid to flow dividers 92 and 94 from pump and tank 80. Though, as mentioned before, it should be understood that cylinders 66*b* can be independently controlled. Solenoid valves 84, 88, and 90 permit the pressure in the pump to charge the respective pivot cylinders and adjustment cylinders and are controlled by an electrical control circuit described below. Optionally, control system 16 may include one or more check valves 89 to prevent pressure drop in respective conduit 82 that delivers fluid from valves 88, 90 to manifold 86 due to leakage that may occur in the solenoid valves.

Figure 27:
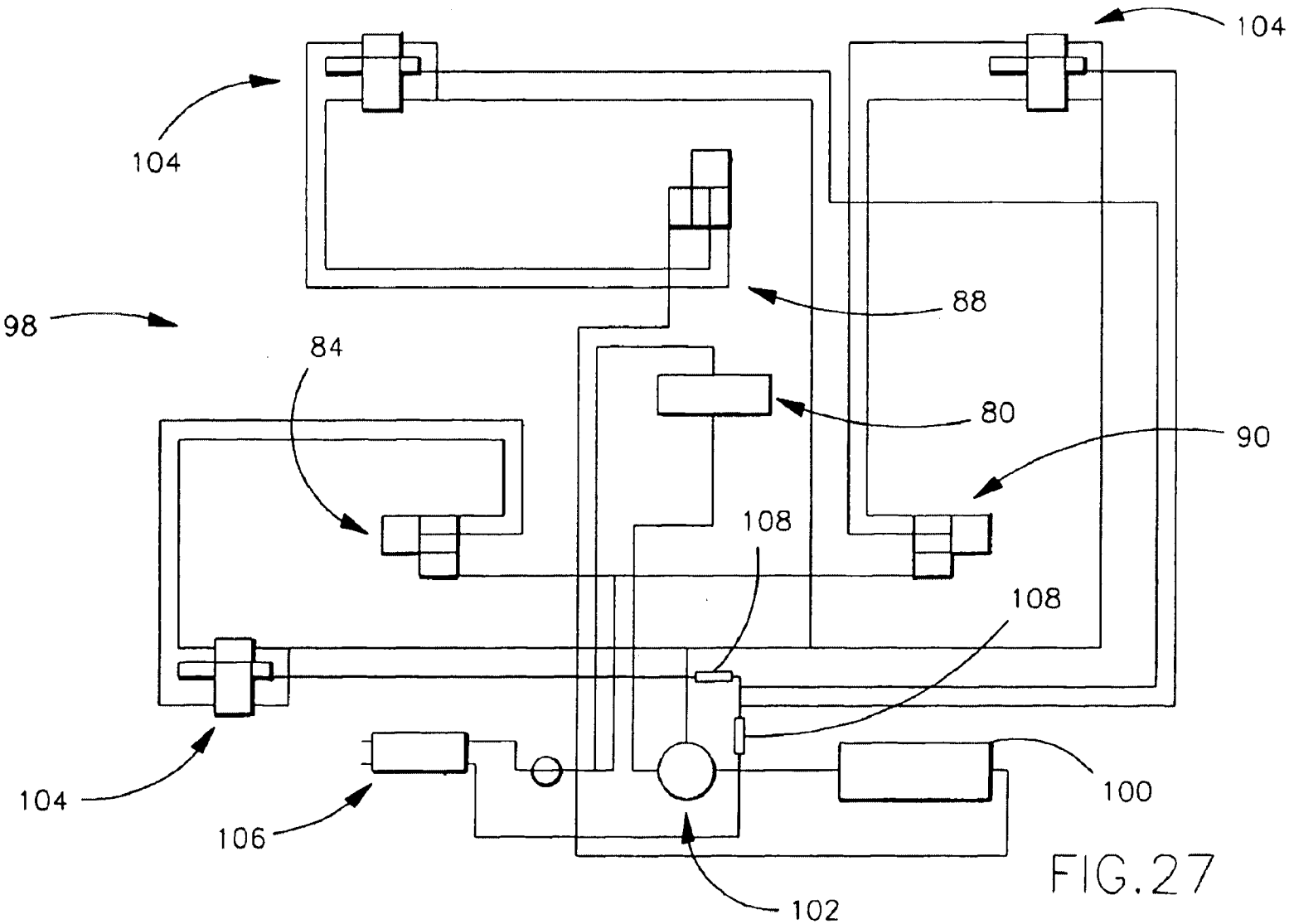
FIG. 27 is a schematic view of a circuit of the control system of the present invention.

The electrical control circuit 98 of control system 16 includes a power source 100, such as a 12-volt battery, a relay, such as a magnetic relay solenoid, which acts as a switch 102, and a plurality of remote controllers or control switches 104. Control switches 104 preferably comprise on-off-on momentary switches, which are commercially available. Switch 102 controls the delivery of power to pump 80. As noted above, remote controllers 104 may be mounted to the undercarriage or to the stretcher base, preferably at the rear end of the undercarriage to provide easy access to the person handling the undercarriage. Controllers 104 control the delivery of power to the respective solenoid valves 84, 88, and 90 to thereby control the flow of hydraulic fluid to and from the respective cylinders 66*a*, 66*b* to and from the tank and pump 80 to thereby control the position and/or length of the respective legs. Optionally, solenoid valves 84, 88, and 90 are provided with a mechanical override actuator, such as button, so that in the event of a power supply failure, the person maneuvering the system can manually control the flow of fluid through the solenoid valves to control the extension or retraction of the cylinders to thereby transfer the undercarriage and stretcher on to the desired support surface, such as the floor of a helicopter. In addition, circuit 98 preferably includes a charger 106, which recharges battery 100 when charger 106 is coupled to the vehicle's electrical system. As in most circuits, circuit 98 optionally includes overdraw protection, such as fuses 108. In addition, circuit 98 preferably includes an emergency disconnect 10 (FIGS. 27 and 27A). Disconnect 10 includes a handle 112 and an electrical connection 114 that is positioned between battery 100 and the main electrical circuit, which is broken when handle 112 is pulled to disconnect the main circuit from the battery as would be understood by those skilled in the art. The handle is preferably located at the rearward end of undercarriage 10, though it may be located elsewhere.

While several forms of the invention have been shown or described, other forms will now be apparent to those skilled in the art. While the hydraulic circuit incorporates the use of a manifold to direct the flow of hydraulic fluid to the various solenoid valves, the manifold may be eliminated with each of the solenoid valves directly connected to the tank and pump. However, in an effort to save space and reduce congestion, the use of a manifold valve or equivalent is desirable, though not necessary. In addition, though the control circuit has been described in reference to an electrical/hydraulic system, the control system may be pneumatic over hydraulic or a pure electrical system. For example, the control system may include electrical actuators, such as servo motors, including linear motors, or the like. Therefore, it will be understood that the embodiments shown in the drawings and described above are merely for illustrative purposes, and are not intended to limit the scope of the invention, which is defined by the claims, which follow as interpreted under the principles of patent law including the doctrine of equivalents.

The embodiments of the invention in which an exclusive property right or privilege is claimed are defined as follows:

1. An undercarriage for transporting a stretcher, said undercarriage comprising:

a support base adapted for supporting a stretcher, said support base having an open compartment and defining an upper plane bounded by an upper surface of said support base and a lower plane bounded by a lower surface of said support base;

a first pair of legs pivotally mounted to the support base, said first pair of legs comprising forward legs;

a second pair of legs pivotally and slidably mounted to the support base, said second pair of legs comprising rearward legs, said first pair of legs being independently pivotal about said support base from said second pair of legs;

a journaled member provided at the distal ends of each leg; and a control system adapted to selectively pivot said first pair of legs to a stowed position and to selectively pivot said second pair of legs to a stowed position, and said control system further adapted to selectively lengthen or shorten said legs to adjust the height of said support base, said control system including a plurality of actuators, said actuators pivoting and adjusting the length of said legs, and said actuators comprising cylinders.

2. The undercarriage according to claim 1, wherein said stowed position of said first pair of legs is between said upper and lower planes.

3. The undercarriage according to claim 1, wherein said stowed position of said second pair of legs is between said upper and lower planes.

4. The undercarriage according to claim 1, wherein said second pair of legs at least partially extend into said open compartment when moved to their stowed position.

5. The undercarriage according to claim 1, wherein said support base includes a plurality of journaled members, said journaled members of said support base enabling a person move said undercarriage across a support surface when said support base is extended over the support surface.

6. The undercarriage according to claim 5, wherein a group of said journaled members are located at a forward end of said support base to form forward journaled members.

7. The undercarriage according to claim 5, wherein a group of said journaled members of said support base are located forward of said rearward legs and rearward of said forward legs to form intermediate journaled members wherein said intermediate journaled members provide support for said undercarriage when said forward legs are pivoted to their stowed position to thereby ease handling of said undercarriage.

8. The undercarriage according to claim 7, wherein said undercarriage has a center of gravity, said intermediate journaled members located at or near said center of gravity.

9. The undercarriage according to claim 7, wherein said undercarriage has a center of gravity, said intermediate journaled members are located rearward of said center of gravity.

10. The undercarriage according to claim 1, wherein said cylinders comprise hydraulic cylinders.

11. An undercarriage for transporting a stretcher, said undercarriage comprising:

a support base adapted for supporting a stretcher, said support base having an open compartment and defining an upper plane bounded by an upper surface of said support base and a lower plane bounded by a lower surface of said support base;

a first pair of legs pivotally mounted to the support base, said first pair of legs comprising forward legs;

a second pair of legs pivotally and slidably mounted to the support base, said second pair of legs comprising rearward legs, said first pair of legs being independently pivotal about said support base from said second pair of legs;

a journaled member provided at the distal ends of each leg; and a control system adapted to selectively pivot said first pair of legs to a stowed position and to selectively pivot said second pair of legs to a stowed position, and said control system further adapted to selectively lengthen or shorten said legs to adjust the height of said support base, said control system including a plurality of actuators, said actuators pivoting and adjusting the length of said legs, each of said legs including a pivot actuator and a height adjustment actuator wherein said pivoting and said adjusting the length of said legs is independent.

12. The undercarriage according to claim 11, wherein said height adjustment actuators are coupled.

13. The undercarriage according to claim 12, wherein said actuators comprise hydraulic cylinders.

14. The undercarriage according to claim 13, wherein said cylinders are hydraulically coupled.

15. An undercarriage for transporting a stretcher, said undercarriage comprising:

a support base adapted for supporting a stretcher, said support base having a frame;

a first pair of legs pivotally mounted to opposed sides of said frame, said first pair of legs comprising forward legs;

a second pair of legs pivotally and slidably mounted to said frame and being extendible into said frame, said second pair of legs comprising rearward legs, said first pair of legs being independently pivotal about said frame from said second pair of legs;

a journaled member provided at the distal ends of each leg; and a control system adapted to selectively pivot said first pair of legs to a stowed position and to selectively pivot said second pair of legs to a stowed position in said frame, said control system including a plurality of actuators, said actuators pivoting said legs, and said actuators comprising hydraulic cylinders.

16. The undercarriage according to claim 15, wherein said control system is further adapted to selectively lengthen or shorten said legs to adjust the height of said support base.

17. The undercarriage according to claim 15, wherein each of said legs includes a cylinder, wherein said cylinders of said front legs are hydraulically coupled wherein said front legs pivot substantially in unison.

18. The undercarriage according to claim 17, wherein said hydraulic cylinders of said front legs are physically coupled.

19. The undercarriage according to claim 15, wherein said cylinders of said rearward legs are hydraulically coupled wherein said rearward legs pivot substantially in unison.

20. An undercarriage for transporting a stretcher, said undercarriage comprising:

a support base adapted for supporting a stretcher, said support base having a frame;

a first pair of legs pivotally mounted to opposed sides of said frame, each of said first pair of legs comprising a forward leg;

a second pair of legs pivotally and slidably mounted to said frame and being extendible into said frame, each of said second pair of legs comprising a rearward leg, said first pair of legs being independently pivotal about said frame from said second pair of legs;

a journaled member provided at the distal ends of each leg; and a control system adapted to selectively pivot said first pair of legs to a stowed position and to selectively pivot said second pair of legs to a stowed position in said frame, said control system including a plurality of actuators, said actuators pivoting said legs, each of said legs including a pivot actuator and a height adjustment actuator, said height adjustment actuators for adjusting the length of said legs wherein the height of said support base can be adjusted.

21. The undercarriage according to claim 20, wherein said pivoting and said height adjusting is independent.

22. The undercarriage according to claim 20, wherein said height adjustment actuators of at least said forward legs are coupled wherein said forward legs lengthen substantially in unison.

23. The undercarriage according to claim 20, wherein said support base includes a plurality of journaled members, said journaled members of said support base enabling a person to translate said undercarriage across a support surface when said first pair of legs are pivoted to their stowed position.

* * * * *

UNITED STATES PATENT AND TRADEMARK OFFICE

CERTIFICATE OF CORRECTION

PATENT NO. : 6,976,696 B2
APPLICATION NO. : 10/652671
DATED : December 20, 2005
INVENTOR(S) : Jason M. O'Krangley and David M Kruithoff It is certified that error appears in the above-identified patent and that said Letters Patent is hereby corrected as shown below:

Column 9:
Line 57, "10" should be --110-- in both occurrences.

Signed and Sealed this

Twelfth Day of June, 2007

JON W. DUDAS
*Director of the United States Patent and Trademark Office*